US011965136B2

(12) United States Patent
Koseoglu

(10) Patent No.: US 11,965,136 B2
(45) Date of Patent: Apr. 23, 2024

(54) CYCLIZATION AND FLUID CATALYTIC CRACKING SYSTEMS AND METHODS FOR UPGRADING NAPHTHA

(71) Applicant: Saudi Arabian Oil Company, Dhahran (SA)

(72) Inventor: Omer Refa Koseoglu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/150,012

(22) Filed: Jan. 15, 2021

(65) Prior Publication Data

US 2022/0228073 A1 Jul. 21, 2022

(51) Int. Cl.
*C10G 63/08* (2006.01)
*C10G 11/18* (2006.01)
(Continued)

(52) U.S. Cl.
CPC ..... *C10G 63/08* (2013.01); *C10G 11/18* (2013.01); *C10G 35/095* (2013.01); *C10G 45/02* (2013.01);
(Continued)

(58) Field of Classification Search
CPC ..... C10G 63/08; C10G 63/04; C10G 11/18; C10G 35/095; C10G 45/02;
(Continued)

(56) References Cited

U.S. PATENT DOCUMENTS 2,944,959 A * 7/1960 Kline ..... C10G 59/06 208/79
3,074,878 A 1/1963 Pappas
(Continued)

FOREIGN PATENT DOCUMENTS

WO 2020021356 A1 1/2020

OTHER PUBLICATIONS

International Search Report and Written Opinion dated Oct. 7, 2021 pertaining to International application No. PCT/US2021/019017 filed Feb. 22, 2021, 14 pages.
(Continued)

*Primary Examiner* — Michelle Stein
(74) *Attorney, Agent, or Firm* — DINSMORE & SHOHL LLP

(57) ABSTRACT

A process for upgrading a naphtha feed includes separating the naphtha feed into at least a light naphtha fraction, contacting the light naphtha fraction with hydrogen in the presence of at least one cyclization catalyst, and contacting the cyclization effluent with at least one cracking catalyst. Contacting the light naphtha fraction with hydrogen in the presence of at least one cyclization catalyst may produce a cyclization effluent comprising a greater concentration of naphthenes compared to the light naphtha fraction. Contacting the cyclization effluent with at least one cracking catalyst under conditions sufficient to crack at least a portion of the cyclization effluent may produce a fluid catalytic cracking effluent comprising light olefins, gasoline blending components, or both. A system for upgrading a naphtha feed includes a naphtha separation unit, a cyclization unit disposed downstream of the naphtha separation unit, and a fluid catalytic cracking unit disposed downstream of the cyclization unit.

18 Claims, 5 Drawing Sheets

(51) Int. Cl.
*C10G 35/095* (2006.01)
*C10G 45/02* (2006.01)
*C10G 63/04* (2006.01)

(52) U.S. Cl.
CPC ..... *C10G 63/04* (2013.01); *C10G 2300/1044* (2013.01); *C10G 2300/202* (2013.01); *C10G 2300/4006* (2013.01); *C10G 2300/4012* (2013.01); *C10G 2300/4018* (2013.01); *C10G 2400/02* (2013.01); *C10G 2400/20* (2013.01); *C10G 2400/30* (2013.01)

(58) Field of Classification Search
CPC ..... C10G 2300/1044; C10G 2300/202; C10G 2300/4006; C10G 2300/4012; C10G 2300/4018; C10G 2400/02; C10G 2400/20; C10G 2400/30; C10G 59/06; C10G 69/04
See application file for complete search history.

(56) References Cited

U.S. PATENT DOCUMENTS 3,114,696 A * 12/1963 Weisz ..... C10G 59/02 208/2
3,714,023 A * 1/1973 Stine ..... C10G 63/04 208/62
3,753,891 A * 8/1973 Graven ..... C10G 35/095 208/62
3,801,494 A * 4/1974 Moore ..... C10G 65/16 208/62
3,894,934 A * 7/1975 Owen ..... C10G 11/05 208/78
3,928,175 A * 12/1975 Owen ..... C10L 1/04 208/66
4,181,599 A * 1/1980 Miller ..... B01J 29/44 208/111.35
4,419,221 A 12/1983 Castagnos, Jr. et al.
4,594,145 A * 6/1986 Roarty ..... C10G 59/06 208/138
4,839,027 A * 6/1989 Absil ..... C10G 35/095 208/138
4,853,105 A * 8/1989 Herbst ..... C10G 11/18 208/113
4,906,353 A * 3/1990 Breckenridge ..... C10G 47/18 208/68
4,962,251 A * 10/1990 Yamamoto ..... C10G 35/095 585/419
5,276,232 A * 1/1994 Inoue ..... C10G 35/095 585/407
5,462,652 A 10/1995 Wegerer
5,525,211 A * 6/1996 Sudhakar ..... C10G 45/08 208/243
6,004,452 A 12/1999 Ash et al.
6,051,128 A * 4/2000 Nacamuli ..... C10G 59/06 585/419
9,221,036 B2 12/2015 Koseoglu et al.
9,796,937 B2 10/2017 Fanget et al.
11,332,678 B2 * 5/2022 Koseoglu ..... C10G 35/085
11,420,192 B2 * 8/2022 Koseoglu ..... C10G 47/20
2004/0226860 A1 * 11/2004 Bourges ..... C10G 45/50 208/89
2006/0205988 A1 9/2006 Rice et al.
2012/0277508 A1 * 11/2012 Gajda ..... C10G 59/06 585/304
2014/0221715 A1 * 8/2014 Bridges ..... C10G 63/08 585/319
2014/0357913 A1 * 12/2014 Funk ..... C10G 69/04 585/319
2015/0284644 A1 * 10/2015 Fanget ..... C10G 11/182 585/321
2015/0284646 A1 * 10/2015 Fanget ..... C10G 63/08 585/321
2015/0315102 A1 11/2015 Lapinski et al.
2018/0179455 A1 * 6/2018 Frey ..... C10G 63/04
2019/0224653 A1 * 7/2019 Koseoglu ..... B01J 37/0211
2021/0269726 A1 * 9/2021 Al-Majnouni ..... C10G 55/06

OTHER PUBLICATIONS

Aitani et al., "Catalytic Upgrading of Light Naphtha to Gasoline Blending Components: A Mini Review", Energy & Fuels, vol. 33, pp. 3828-3843, 2019.
Ghosh et al., "Development of a Detailed Gasoline Composition-Based Octane Model", Ind. Eng. Chem Res., vol. 45, pp. 337-345, 2006.
Hidalgo et al., "Current uses and trends in catalytic isomerization, alkylation and etherification processes to improve gasoline quality", Central European Journal of Chemistry, vol. 12, No. 1, pp. 1-13, 2014.
Kuchling et al., "Potential of On-Board Gasoline Upgrading for Enhancement of Engine Efficiency", Chem. Eng. Technol., vol. 40, No. 9, pp. 1644-1651, 2017.
Organization of the Petroleum Exporting Countries, "OPEC Annual Statistical Bulletin", 1965-2018 53rd edition, 2018.
Yu et al., "Alkane Activation Initiated by Hydride Transfer: Co-conversion of Propane and Methanol over H-ZSM-5 Zeolite", Angew. Chem. Int. Ed., vol. 54, pp. 7363-7366, 2015.
International Search Report and Written Opinion pertaining to International Application No. PCT/US2020/015048, dated Oct. 29, 2020 (17 pages).

* cited by examiner

CYCLIZATION AND FLUID CATALYTIC CRACKING SYSTEMS AND METHODS FOR UPGRADING NAPHTHA

BACKGROUND

Field

The present disclosure generally relates to processes and systems for upgrading hydrocarbons, more specifically, systems and processes for upgrading naphtha to greater value chemical products and intermediates.

Technical Background

Hydrocarbon feeds, such as naphtha, can be converted to chemical products and intermediates such as olefins and aromatic compounds, which are basic intermediates for a large portion of the petrochemical industry. The worldwide increasing demand for light olefins and aromatic compounds remains a major challenge for many integrated refineries. In particular, the production of some valuable light olefins, such as ethylene, propene, and butenes, has attracted increased attention as pure olefin streams are considered the building blocks for polymer synthesis. Additionally, aromatic compounds such as benzene, toluene, ethylbenzene, and xylenes can be valuable intermediates for synthesizing polymers and other organic compounds as well as for fuel additives. Further the processing of naphtha streams, such as light naphtha, may be desirable, as light naphtha possess a low octane number and its use in gasoline production is limited.

SUMMARY

Light naphtha, which is generally described as a $C_5$-$C_6$ hydrocarbon, may be produced by routine refinery processes or gas plants. Light naphtha possesses a low octane number. Typically, the octane number of light naphtha may range from 40 to 60. Over time, light naphtha has become relatively limited for use as a blending stock for gasoline production due to this low octane number. Light naphtha may be isomerized to increase its octane number and be used in gasoline blending despite its vapor pressure limitations. Light naphtha may also be commonly used as a feed for a stream cracker for light olefin production. However, the transformation of light naphtha into desirable gasoline-blending components or desirable chemicals is an ongoing challenge.

The fluid catalytic cracking (FCC) unit is one of the primary hydrocarbon conversion units in the modern petroleum refinery. The FCC unit may predominantly produce gasoline in a conventional FCC unit, or produce propylene in a high severity FCC unit. In high severity FCC units, the hydrocarbons may be converted to gasoline over a cracking catalyst, which can also be converted to olefins over a cracking catalyst additive.

In FCC processes, hydrocarbons are catalytically cracked with an acidic catalyst maintained in a fluidized state. One of the main products from such processes has typically been gasoline. The gasoline and other hydrocarbon products may be further cracked to light olefins, such as ethylene, propylene, butenes, or combinations of these, during the FCC process. Despite the many advances in FCC processes, upgrading light naphtha in an FCC process is limited due to the paraffins in the light naphtha are not being reactive in the FCC process. The industry is constantly seeking improved systems and methods for upgrading hydrocarbons, including light naphtha, to produce greater value products and intermediates.

Accordingly, there is an ongoing need for systems and methods of upgrading hydrocarbons, such as light naphtha, to increase the efficiency of the upgrading process and improve yields of desired products, such as gasoline-blending components and light olefins. As FCC processes are typically used to produce gasoline and gasoline-blending components, there has been a desire to process light naphtha in FCC units to use light naphtha for gasoline blending. The present disclosure is directed to systems and methods for upgrading naphtha feeds to produce greater value products and intermediates, such as gasoline-blending components, light olefins, or both, by cyclizing and cracking light naphtha. Cyclizing the light naphtha may convert a portion of paraffins in the light naphtha to naphthenes, which are more reactive in FCC process compared to the non-reactive paraffins.

According to one or more aspects of the present disclosure, a process for separating and upgrading a naphtha feed may include passing the naphtha feed to a naphtha separation unit that separates the naphtha feed into at least a light naphtha fraction and a heavy naphtha fraction. The process may further include passing the light naphtha fraction to a cyclization unit. The cyclization unit may contact the light naphtha fraction with hydrogen in the presence of at least one cyclization catalyst to produce a cyclization effluent. The cyclization effluent may comprise a greater concentration of naphthenes compared to the light naphtha fraction. The process may further include passing the cyclization effluent to a fluid catalytic cracking (FCC) unit. The FCC unit may contact the cyclization effluent with at least one cracking catalyst under conditions sufficient to crack at least a portion of the cyclization effluent to produce an FCC effluent. The FCC effluent comprising light olefins, gasoline blending components, or both.

In one or more other aspects of the present disclosure, a process for upgrading a naphtha feed may include separating the naphtha feed into at least a light naphtha fraction and a heavy naphtha fraction. The process may further include contacting the light naphtha fraction with hydrogen in the presence of at least one cyclization catalyst to produce a cyclization effluent. The cyclization effluent may comprise a greater concentration of naphthenes compared to the light naphtha fraction. The process may further include contacting the cyclization effluent with at least one cracking catalyst under conditions sufficient to crack at least a portion of the cyclization effluent to produce an FCC effluent. The FCC effluent comprising light olefins, gasoline blending components, or both.

In still other aspects of the present disclosure, a system for upgrading a naphtha feed may include a naphtha separation unit, a cyclization unit, and an FCC unit. The naphtha separation unit may separate a naphtha feed into at least a light naphtha fraction and a heavy naphtha fraction. The cyclization unit may be disposed downstream of the naphtha separation unit and may contact the light naphtha fraction with hydrogen in the presence of at least one cyclization catalyst to produce a cyclization effluent. The FCC unit may be disposed downstream of the cyclization unit and may crack the cyclization effluent to produce a fluid catalytic cracking effluent.

Additional features and advantages of the technology described in this disclosure will be set forth in the detailed description which follows, and in part will be readily apparent to those skilled in the art from the description or recognized by practicing the technology as described in this disclosure, including the detailed description which follows, the claims, as well as the appended drawings.

BRIEF DESCRIPTION OF THE DRAWINGS

The following detailed description of specific embodiments of the present disclosure can be best understood when read in conjunction with the following drawings, where like structure is indicated with like reference numerals and in which.

Figure 1:
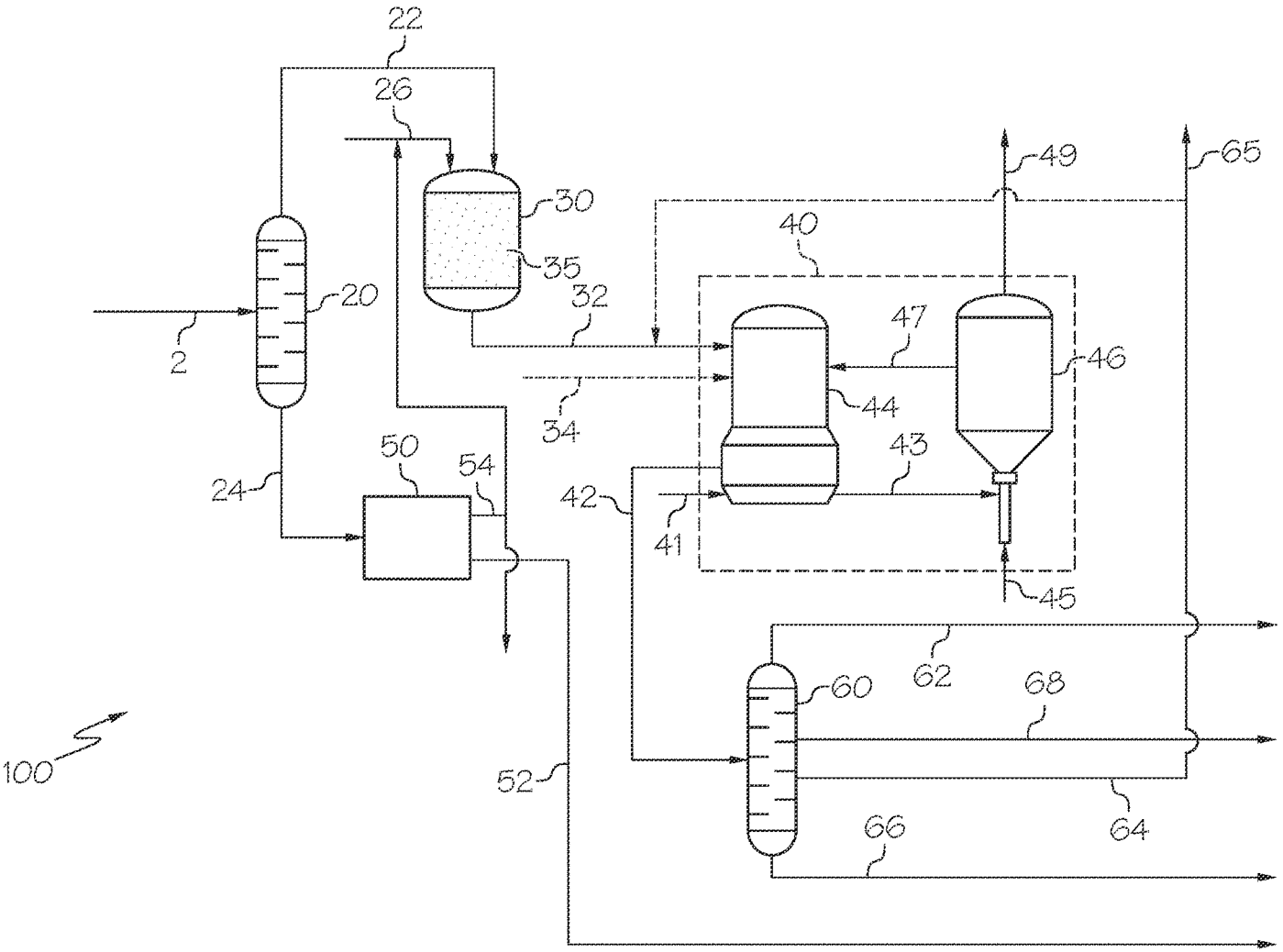
FIG. 1 schematically depicts a generalized flow diagram of a system for upgrading a naphtha feed, according to one or more embodiments shown and described in this disclosure.

For the purpose of describing the simplified schematic illustrations and descriptions of FIGS. 1-5, the numerous valves, temperature sensors, electronic controllers, and the like that may be employed and well known to those of ordinary skill in the art of certain chemical processing operations are not included. Further, accompanying components that are often included in chemical processing operations, such as, for example, air supplies, heat exchangers, surge tanks, catalyst hoppers, or other related systems are not depicted. It would be known that these components are within the spirit and scope of the present embodiments disclosed. However, operational components, such as those described in the present disclosure, may be added to the embodiments described in this disclosure.

It should further be noted that arrows in the drawings refer to process streams. However, the arrows may equivalently refer to transfer lines that may serve to transfer process steams between two or more system components. Additionally, arrows that connect to system components define inlets or outlets in each given system component. The arrow direction corresponds generally with the major direction of movement of the materials of the stream contained within the physical transfer line signified by the arrow. Furthermore, arrows that do not connect two or more system components signify a product stream which exits the depicted system or a system inlet stream which enters the depicted system. Product streams may be further processed in accompanying chemical processing systems or may be commercialized as end products. System inlet streams may be streams transferred from accompanying chemical processing systems or may be non-processed feedstock streams. Some arrows may represent recycle streams, which are effluent streams of system components that are recycled back into the system. However, it should be understood that any represented recycle stream, in some embodiments, may be replaced by a system inlet stream of the same material, and that a portion of a recycle stream may exit the system as a system product.

Additionally, arrows in the drawings may schematically depict process steps of transporting a stream from one system component to another system component. For example, an arrow from one system component pointing to another system component may represent "passing" a system component effluent to another system component, which may include the contents of a process stream "exiting" or being "removed" from one system component and "introducing" the contents of that product stream to another system component.

It should be understood that two or more process streams are "mixed" or "combined" when two or more lines intersect in the schematic flow diagrams of FIGS. 1-5. Mixing or combining may also include mixing by directly introducing both streams into a like reactor, separation device, or other system component. For example, it should be understood that when two streams are depicted as being combined directly prior to entering a separation unit or reactor, that in some embodiments the streams could equivalently be introduced into the separation unit or reactor and be mixed in the reactor.

Reference will now be made in greater detail to various embodiments of the present disclosure, some embodiments of which are illustrated in the accompanying drawings. Whenever possible, the same reference numerals will be used throughout the drawings to refer to the same or similar parts.

DETAILED DESCRIPTION

The present disclosure is directed to cyclization and fluid catalytic cracking processes for upgrading naphtha. In particular, the present disclosure is directed to processes comprising separating a naphtha feed into at least a light naphtha fraction, contacting the light naphtha fraction with hydrogen in the presence of at least one cyclization catalyst to produce a cyclization effluent, and contacting the cyclization effluent with at least one cracking catalyst under conditions sufficient to crack at least a portion of the cyclization effluent to produce a fluid catalytic cracking effluent. The present disclosure is also directed to cyclization and fluid catalytic cracking systems for upgrading naphtha. In particular, the systems may comprise a naphtha separation unit, a cyclization unit disposed downstream of the naphtha separation unit, and a fluid catalytic cracking unit disposed downstream of the cyclization unit.

The various cyclization and fluid catalytic cracking processes and systems of the present disclosure for upgrading naphtha may provide increased efficiency for the upgrading of naphtha compared to conventional processes and systems of upgrading naphtha. That is, the various cyclization and fluid catalytic cracking processes and systems for upgrading naphtha may increase the conversion of a naphtha feed, including a light naphtha portion, and may increase the yield of greater value products and intermediates, such as light olefins (ethylene, propylene, butenes, or combinations of these) and gasoline blending components, among other features.

As used in this disclosure, a "catalyst" may refer to any substance that increases the rate of a specific chemical reaction. Catalysts and catalyst components described in this disclosure may be utilized to promote various reactions, such as, but not limited to cracking, aromatic cracking, or combinations of these.

As used in this disclosure, "cracking" may refer to a chemical reaction where a molecule having carbon-carbon bonds is broken into more than one molecule by the breaking of one or more of the carbon-carbon bonds; where a compound including a cyclic moiety, such as an aromatic, is converted to a compound that does not include a cyclic moiety; or where a molecule having carbon-carbon double bonds are reduced to carbon-carbon single bonds. Some catalysts may have multiple forms of catalytic activity, and calling a catalyst by one particular function does not render that catalyst incapable of being catalytically active for other functionality.

As used throughout the present disclosure, the term "light olefins" may refer to one or more of ethylene, propylene, butenes, or combinations of these.

As used throughout the present disclosure, the term "butene" or "butenes" may refer to one or more than one isomer of butene, such as one or more of 1-butene, trans-2-butene, cis-2-butene, isobutene, or mixtures of these isomers. As used throughout the present disclosure, the term "normal butenes" may refer to one or more than one of 1-butene, trans-2-butene, cis-2-butene, or mixtures of these isomers, and does not include isobutene. As used throughout the present disclosure, the term "2-butene" may refer to trans-2-butene, cis-2-butene, or a mixture of these two isomers.

As used throughout the present disclosure, the term "crude oil" or "whole crude oil" may refer to crude oil received directly from an oil field or from a desalting unit without having any fraction separated by distillation.

As used throughout the present disclosure, the terms "upstream" and "downstream" may refer to the relative positioning of unit operations with respect to the direction of flow of the process streams. A first unit operation of a system may be considered "upstream" of a second unit operation if process streams flowing through the system encounter the first unit operation before encountering the second unit operation. Likewise, a second unit operation may be considered "downstream" of the first unit operation if the process streams flowing through the system encounter the first unit operation before encountering the second unit operation.

As used in the present disclosure, passing a stream or effluent from one unit "directly" to another unit may refer to passing the stream or effluent from the first unit to the second unit without passing the stream or effluent through an intervening reaction system or separation system that substantially changes the composition of the stream or effluent. Heat transfer devices, such as heat exchangers, preheaters, coolers, condensers, or other heat transfer equipment, and pressure devices, such as pumps, pressure regulators, compressors, or other pressure devices, are not considered to be intervening systems that change the composition of a stream or effluent. Combining two streams or effluents together also is not considered to comprise an intervening system that changes the composition of one or both of the streams or effluents being combined. Simply dividing a stream into two streams having the same composition is also not considered to comprise an intervening system that changes the composition of the stream.

As used in this disclosure, a "separation unit" refers to any separation device that at least partially separates one or more chemicals that are mixed in a process stream from one another. For example, a separation unit may selectively separate differing chemical species from one another, forming one or more chemical fractions. Examples of separation units include, without limitation, distillation columns, flash drums, knock-out drums, knock-out pots, centrifuges, filtration devices, traps, scrubbers, expansion devices, membranes, solvent extraction devices, and the like. It should be understood that separation processes described in this disclosure may not completely separate all of one chemical consistent from all of another chemical constituent. It should be understood that the separation processes described in this disclosure "at least partially" separate different chemical components from one another, and that even if not explicitly stated, it should be understood that separation may include only partial separation. As used in this disclosure, one or more chemical constituents may be "separated" from a process stream to form a new process stream. Generally, a process stream may enter a separation unit and be divided or separated into two or more process streams of desired composition. Further, in some separation processes, a "light fraction" and a "heavy fraction" may separately exit the separation unit. In general, the light fraction stream has a lesser boiling point than the heavy fraction stream. It should be additionally understood that where only one separation unit is depicted in a figure or described, two or more separation units may be employed to carry out the identical or substantially identical separation. For example, where a distillation column with multiple outlets is described, it is contemplated that several separators arranged in series may equally separate the feed stream and such embodiments are within the scope of the presently described embodiments.

As used in this disclosure, the term "effluent" may refer to a stream that is passed out of a reactor, a reaction zone, or a separation unit following a particular reaction or separation. Generally, an effluent has a different composition than the stream that entered the separation unit, reactor, or reaction zone. It should be understood that when an effluent is passed to another system unit, only a portion of that system stream may be passed. For example, a slip stream (having the same composition) may carry some of the effluent away, meaning that only a portion of the effluent may enter the downstream system unit. The term "reaction effluent" may more particularly be used to refer to a stream that is passed out of a reactor or reaction zone.

It should further be understood that streams may be named for the components of the stream, and the component for which the stream is named may be the major component of the stream (such as comprising from 50 weight percent (wt. %), from 70 wt. %, from 90 wt. %, from 95 wt. %, from 99 wt. %, from 99.5 wt. %, or even from 99.9 wt. % of the contents of the stream to 100 wt. % of the contents of the stream). It should also be understood that components of a stream are disclosed as passing from one system component to another when a stream comprising that component is disclosed as passing from that system component to another. For example, a disclosed "hydrogen stream" passing to a first system component or from a first system component to a second system component should be understood to equivalently disclose "hydrogen" passing to the first system component or passing from a first system component to a second system component.

Referring now to FIG. 1, the systems 100 for separating and upgrading a naphtha feed 2 may include a naphtha separation unit 20, a cyclization unit 30 downstream of the naphtha separation unit 20, and an FCC unit 40 downstream of the cyclization unit 30. The system 100 may further include a naphtha reforming unit 50 disposed downstream of the naphtha separation unit 20. The naphtha separation unit 20 may be operable to separate the naphtha feed 2 into at least a light naphtha fraction 22 and a heavy naphtha fraction 24. The cyclization unit 30 may be operable to contact the light naphtha fraction 22 with hydrogen 26 in the presence of at least one cyclization catalyst 35. Contacting the light naphtha fraction 22 with hydrogen 26 in the presence of at least one cyclization catalyst 35 may produce a cyclization effluent 32 having a greater concentration of naphthenes compared to the light naphtha fraction 22. The FCC unit 40 may be operable to contact the cyclization effluent 32 with at least one cracking catalyst under conditions sufficient crack at least a portion of the cyclization effluent 32 to produce an FCC effluent 42. The FCC effluent 42 may comprise light olefins, gasoline blending components, or both. The naphtha reforming unit 50 may be operable to contact the heavy naphtha fraction 24 in the naphtha reforming unit 50 to produce a naphtha reformate 52.

The naphtha feed 2 may comprise $C_{5+}$ hydrocarbons, such as $C_{5+}$ paraffins. For example, the naphtha feed 2 may comprise $C_5$-$C_{12}$ hydrocarbons, such as $C_5$-$C_{12}$ paraffins. The naphtha feed 2 may comprise a nominal boiling temperature range of from 9 degrees Celsius (° C.) to 220° C. It will be appreciated by those skilled in the art that the boiling point may range between various operations and between various sources of the naphtha feed 2. The naphtha feed 2 may be a naphtha from any source. The naphtha feed 2 may comprise a straight run naphtha or an intermediate stream from any refinery process units. For example, the naphtha feed 2 may comprise a straight run naphtha from distillation or processing of crude oil. Additionally or alternatively, the naphtha feed 2 may include an intermediate naphtha stream from a coker, a visbreaker, or a hydrocracker. Other sources of naphtha streams are contemplated.

Referring again to FIG. 1, the naphtha feed 2 may be passed to the naphtha separation unit 20. The naphtha separation unit 20 may include one or a plurality of separation units. The naphtha separation unit 20 may be operable to separate the naphtha feed 2 into at least a light naphtha fraction 22 and a heavy naphtha fraction 24. The naphtha separation unit 20 may be operable to separate the naphtha feed 2 by distillation into at least the light naphtha fraction 22 and the heavy naphtha fraction 24. The naphtha separation unit 20 may operate at a temperature ranging from 40° C. to 75° C. Depending on the naphtha feed 2, the separation point may be the boiling point of hexane, which boils in a range from 49° C. to 70° C. For example the naphtha separation unit 20 may operate at a temperature ranging from 40° C. to 55° C., from 45° C. to 60° C., from 50° C. to 65° C., from 65° C. to 70° C., or from 60° C. to 75° C. In some embodiments, depending on the naphtha feed 2, passing the naphtha feed 2 to a naphtha separation unit 20 may be optional, such as when the naphtha feed 2 comprises greater than 60%, greater than 70%, greater than 80%, or even greater than 90% by weight of constituents having boiling point temperatures less than or equal to 75° C.

The light naphtha fraction 22 may comprise $C_5$-$C_6$ hydrocarbons, such as $C_5$-$C_6$ paraffins. The light naphtha fraction 22 may include at least 80%, at least 90%, at least 95%, at least 98%, or at least 99% by weight of the $C_5$-$C_6$ hydrocarbons from the naphtha feed 2. The light naphtha fraction 22 may include at least 80%, at least 90%, at least 95%, at least 98%, or even at least 99% of the constituents of the naphtha feed 2 having boiling point temperatures less than or equal to 70° C. The light naphtha fraction 22 may consist of, or consist essentially of, $C_5$-$C_6$ hydrocarbons, such as $C_5$-$C_6$ paraffins.

The heavy naphtha fraction 24 may comprise $C_{7+}$ hydrocarbons, such as $C_{7+}$ paraffins. The heavy naphtha fraction 24 may comprise $C_7$-$C_{12}$ hydrocarbons, such as $C_7$-$C_{12}$ paraffins. The heavy naphtha fraction 24 may include at least 80%, at least 90%, at least 95%, at least 98%, or even at least 99% by weight of the $C_7$+, such as $C_7$-$C_{12}$ hydrocarbons from the naphtha feed 2. The heavy naphtha fraction 24 may include at least 80%, at least 90%, at least 95%, at least 98%, or even at least 99% of the constituents of the naphtha feed 2 having boiling point temperatures greater than 70° C. from the naphtha feed 2. The heavy naphtha fraction 24 may consist of, or consist essentially of, $C_{7+}$ hydrocarbons, such as $C_{7+}$ paraffins. Alternatively or additionally, the heavy naphtha fraction 24 may consist of, or consist essentially of, $C_7$-$C_{12}$ hydrocarbons, such as $C_7$-$C_{12}$ paraffins.

Referring to FIGS. 1, the system 100 may include the cyclization unit 30, which may be disposed downstream of the naphtha separation unit 20. The cyclization unit 30 may be in fluid communication with the naphtha separation unit 20 and may receive all or a portion of the light naphtha fraction 22 from the naphtha separation unit 20. The light naphtha fraction 22 may be passed directly from the naphtha separation unit 20 to the cyclization unit 30 without passing through any intervening reactor or separation system. The cyclization unit 30 may be operable to contact at least a portion of the light naphtha fraction 22 with hydrogen 26 in the presence of at least one cyclization catalyst 35 to produce a cyclization effluent 32. The hydrogen 26 may include a recycled hydrogen stream, such as a portion of hydrogen effluent 54 recovered from the naphtha reforming unit 50, a portion of excess hydrogen from a desulfurization unit 10 (FIG. 2), or a portion of excess hydrogen recovered from the cyclization unit 30 (either immediately after the cyclization unit 30 or downstream of the FCC unit 40) or supplemental hydrogen from an external hydrogen source inside or outside the battery limits of the refinery. The hydrogen 26 may be passed directly to the cyclization unit 30 or may be combined with the light naphtha fraction 22 upstream of the cyclization unit 30.

The cyclization unit 30 may include any type of reactor suitable for contacting the light naphtha fraction 22 with hydrogen 26 in the presence of the cyclization catalyst 35. Suitable reactors may include, but are not limited to, fixed bed reactors, moving bed reactors, fluidized bed reactors, plug flow reactors, other types of reactors, or combinations of reactors. The cyclization unit 30 may include one or more fixed bed reactors, which may be operated in downflow, upflow, or horizontal flow configurations.

The cyclization catalyst 35 in the cyclization unit 30 may be any catalyst operable to cyclize a portion of light paraffinic naphtha in the light naphtha fraction 22 to form naphthenes. The cyclization catalyst 35 may be a zeolite containing catalyst. The zeolite can be one or more of or derived from FAU, *BEA, MOR, MFI, or MWW framework types, wherein each of these codes correspond to a zeolite structure present in the database of zeolite structures as maintained by the Structure Commission of the International Zeolite Association. The cyclization catalyst 35 in the cyclization unit 30 can include one or more metals from Groups 6-10 of the IUPAC periodic table. The one or more metals from Groups 6-10 of the IUPAC periodic table may be an active phase metal disposed at the surfaces of the catalyst support material. The active phase metal may be deposited on the surfaces of the catalyst support material or incorporated into the catalyst support material, such as incorporated into the matrix formed from the binder and zeolite components. The one or more metals from Groups 6-10 of the IUPAC periodic table may be an active phase metal selected from the group consisting of, for example, iron, cobalt, nickel, rhodium, palladium, silver, iridium, platinum, gold, molybdenum, tungsten and combinations thereof. In embodiments, the cyclization catalyst 35 may include platinum as the active phase metal supported on the catalyst support material. The IUPAC Group 6-10 metals can be present in the cyclization catalyst 35 in an amount ranging from 0.01 to 40 percent by weight of the cyclization catalyst 35. The cyclization catalyst 35 may include from 0.01 wt. % to 40 wt. % iron, cobalt, nickel, rhodium, palladium, silver, iridium, platinum, gold, molybdenum, tungsten, or combinations thereof. For example, the cyclization catalyst 35 in the cyclization unit 30 may be a catalyst described in U.S. Pat. No. 9,221,036 B2.

In embodiments, the cyclization catalyst 35 may include a catalyst support material made of an ultra-stable Y-type (USY) zeolite. The USY zeolite may be a framework-substituted zeolite, in which a part of aluminum atoms constituting the zeolite framework are substituted with zirconium atoms, hafnium atoms, titanium atoms, or a combination of zirconium atoms and hafnium atoms. The cyclization catalyst 35 may comprise from 1 wt. % to 80 wt. % framework-substituted ultra-stable Y-type zeolite based on the total weight of the cyclization catalyst 35. The composition of the cyclization catalyst 35 may be binder oxide from alumina, silica, titania, or combinations of these. The framework substituted USY zeolite may comprise a crystal lattice constant from 2.430 nanometers to 2.450 nanometers and a specific surface area from 600 square meters per gram to 900 square meters per gram. The cyclization catalyst 35 in the cyclization unit 30 can further include an acidic component being at least one member of the group consisting of amorphous silica-alumina, zeolite, and combinations thereof. In embodiments, the cyclization catalyst 35 may include platinum as an active phase metal supported on a catalyst support material comprising the framework-substituted USY zeolite.

The cyclization unit 30 may contact the light naphtha fraction 22 with hydrogen 26 in the presence of the cyclization catalyst 35 at operating conditions sufficient to cause at least a portion of the hydrocarbons in the light naphtha fraction 22 to undergo cyclization to produce the cyclization effluent 32, where the cyclization effluent 32 comprises naphthenes. The cyclization unit 30 may be operated at an operating temperature in the range of from 350° C. to 550° C., such as from 400° C. to 550° C. or from 450° C. to 550° C., and an operating pressure of from 1 MPa (10 bar) to 4 MPa (40 bar), such as from 1 MPa (10 bar) to 3 MPa (30 bar) or from 1 MPa (10 bar) to 2 MPa (20 bar). The molar ratio of hydrogen 26 to feed fed to the cyclization unit 30 may be from of 1 to 10, such as from 1 to 5, or from 1 to 3, where the feed can be the light naphtha fraction 22 from the naphtha separation unit 20. The cyclization unit 30 may operate at a liquid hourly space velocity (LHSV) of from 1 per hour to 10 per hour, such as from 1 per hour to 5 per hour or from 1 per hour to 3 per hour.

Contacting the light naphtha fraction 22 with hydrogen 26 in the presence of the cyclization catalyst 35 at the operating conditions of the cyclization unit 30 may cause at least a portion of paraffinic compounds in the light naphtha fraction 22 to undergo cyclization reactions to form naphthenes. The cyclization unit 30 may be in fluid communication with the FCC unit 40 to pass the cyclization effluent 32 from the cyclization unit 30 to FCC unit 40.

Referring again to FIG. 1, the system 100 may include the FCC unit 40, as previously discussed. The FCC unit 40 may include the FCC reactor 44 and the catalyst regeneration unit 46. The FCC unit 40 may be disposed downstream of the cyclization unit 30. The FCC unit 40 may be in fluid communication with the cyclization unit 30 and may receive the cyclization effluent 32 from the cyclization unit 30. The cyclization effluent 32 may be passed directly from the cyclization unit 30 to the FCC unit 40 without passing through any intervening reactor or separation system. As used in the present disclosure in the context of FIG. 1, the FCC unit 40 generally refers to a reactor (the FCC reactor 44 of the FCC unit 40) in which a major process reaction takes place, such as the upgrading of a hydrocarbon feed to form light olefins.

In embodiments, a supplemental FCC feed 34 may also be passed to the FCC unit 40. That is, the cyclization effluent 32 and the supplemental FCC feed 34 may both be passed to the FCC unit 40 and contacted with at least one cracking catalyst to produce the FCC effluent 42. The supplemental FCC feed 34 may be combined with the cyclization effluent 32 upstream of the FCC unit 40. Alternatively, the supplemental FCC feed 34 may be passed separately to the FCC unit 40 and combined with the cyclization effluent 32 within the FCC reactor 44 of the FCC unit 40.

The supplemental FCC feed 34 may include one or more of crude oil, synthetic crude oil, bitumen, oil sand, shale oil, coal liquid, naphtha, diesel, vacuum gas oil, vacuum residue, de-metalized oil, de-asphalted oil, coker gas oil, cycle oil, gas oil, or combinations of these. The supplemental FCC feed 34 may be derived from one or more of crude oil, synthetic crude oil, bitumen, oil sand, shale oil, coal liquid, naphtha, diesel, vacuum gas oil, vacuum residue, de-metalized oil, de-asphalted oil, coker gas oil, cycle oil, gas oil, or combinations of these. The supplemental FCC feed 34 may have an atmospheric boiling point range greater than or equal to 350° C. As used through the present disclosure, "atmospheric boiling point range" may refer to the temperature interval from the initial boiling point to a final boiling point at atmospheric pressure, where the initial boiling point refers to the temperature at which the first drop of distillation product is obtained and the final boiling point refers to the temperature at which the highest-boiling point compounds evaporate. The supplemental FCC feed 34 may comprise a hydrocracking recycle stream or unconverted bottoms stream from a hydrocracking unit.

Figure 2:
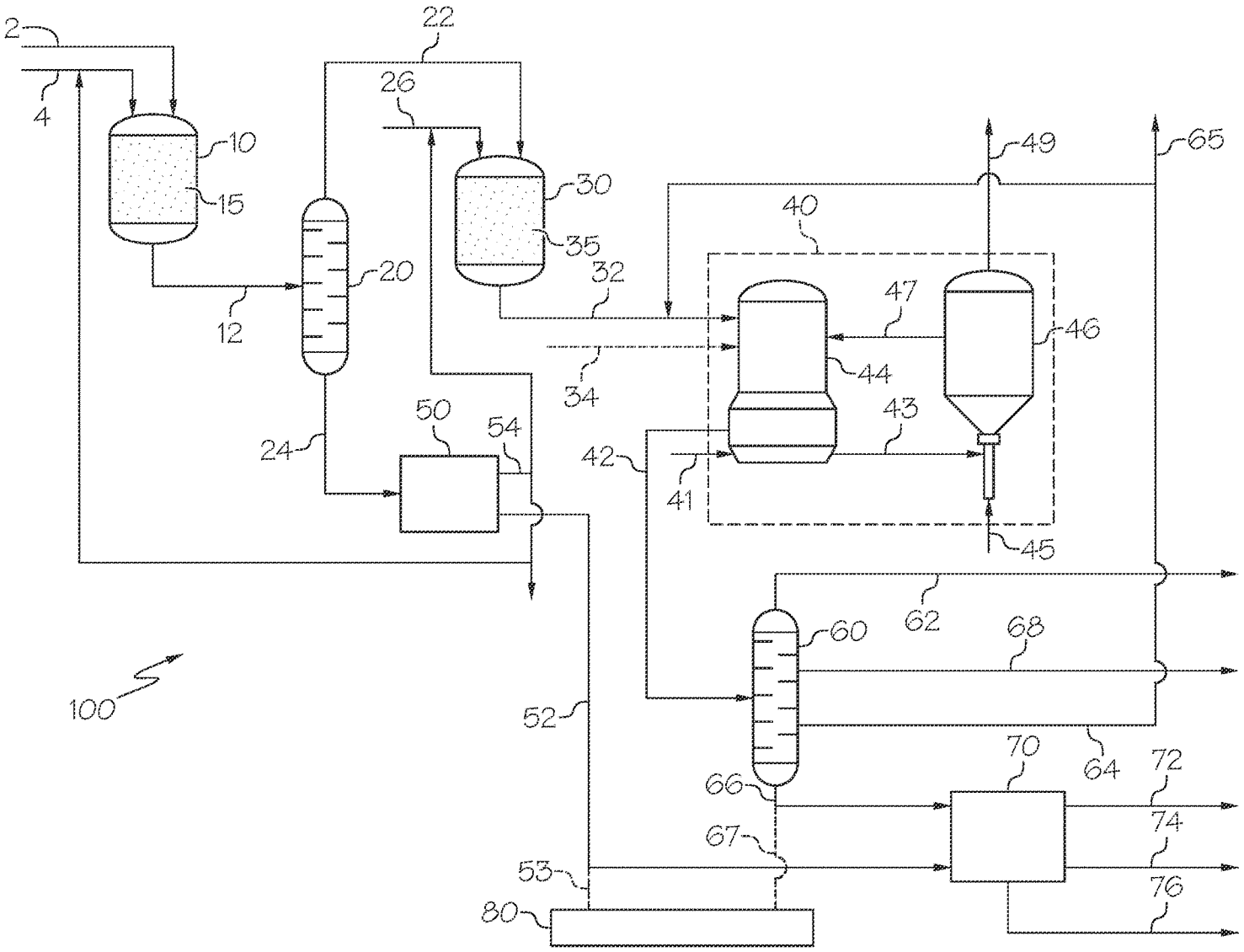
FIG. 2 schematically depicts a generalized flow diagram of another system for upgrading a naphtha feed, including desulfurizing the naphtha feed, according to one or more embodiments shown and described in this disclosure.
Figure 3:
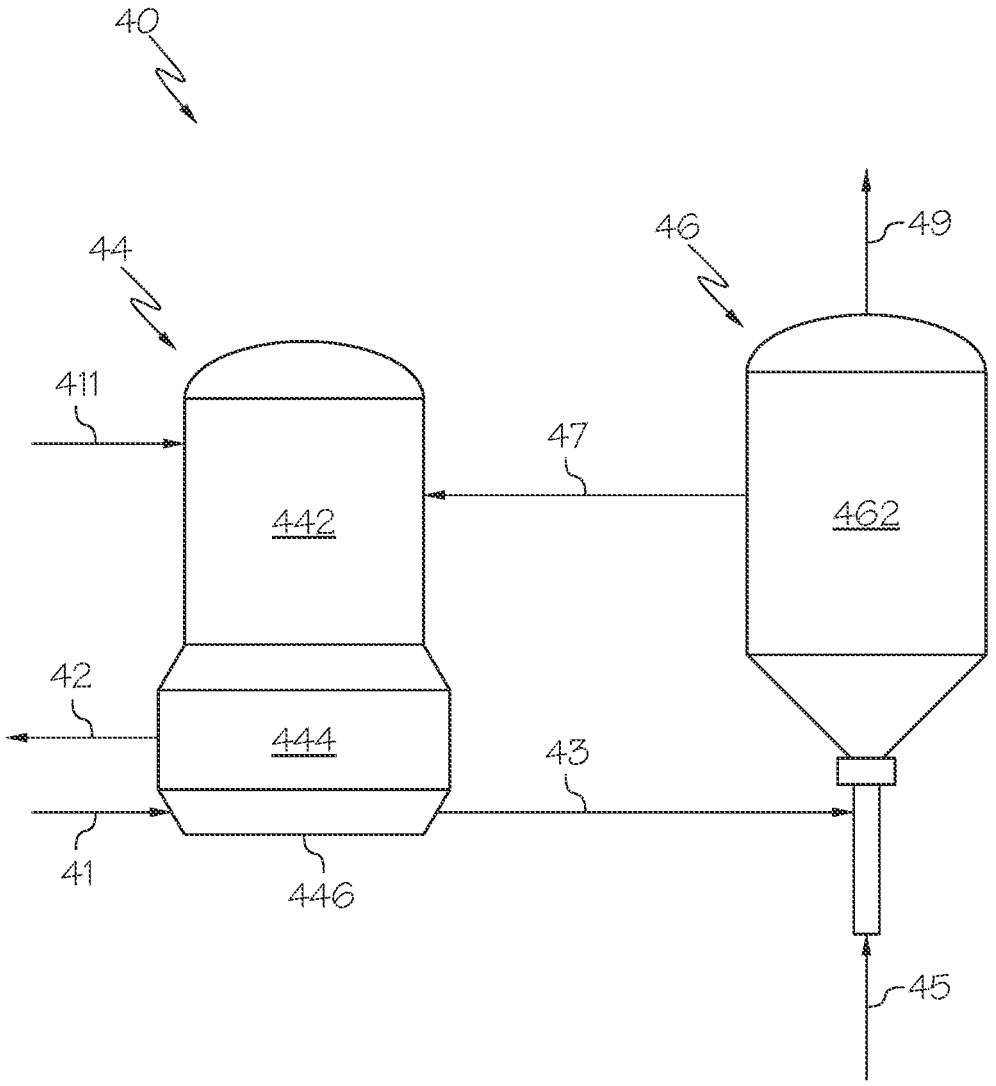
FIG. 3 schematically depicts a generalized flow diagram of an FCC riser unit for upgrading a naphtha feed, according to one or more embodiments shown and described in this disclosure.
Figure 4:
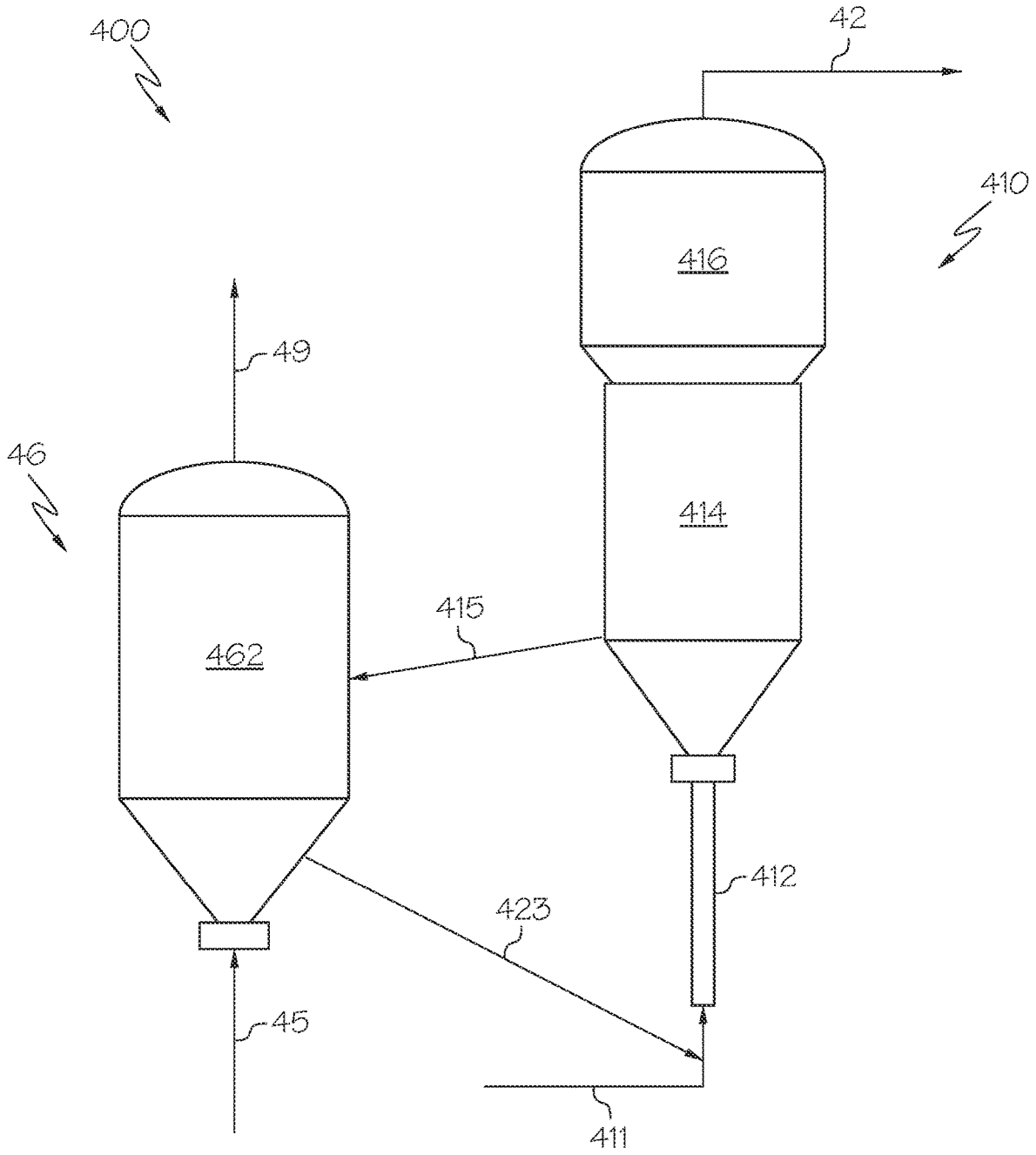
FIG. 4 schematically depicts a generalized flow diagram of an FCC downer unit for upgrading a naphtha feed, according to one or more embodiments shown and described in this disclosure.

Referring to FIGS. 3 and 4, two embodiments of FCC units are schematically depicted. FIG. 3 shows a more detailed view of the FCC unit 40 of FIGS. 1-2. FIG. 4 shows an alternative FCC unit 400 that may be substituted for the FCC unit 40 of FIGS. 1-2. The FCC units schematically depicted in FIGS. 3 and 4 are provided as two options for conducting fluidized catalytic cracking. However, any FCC unit configuration may be used and the FCC unit of the present disclosure is not intended to be limited to the configurations shown in FIGS. 3 and 4.

Referring to FIGS. 1, 2, and 3, one embodiment of an FCC unit 40 that may be suitable for use with for the methods of upgrading a hydrocarbon feed described in the present disclosure is schematically depicted. Again, it should be understood that other reactor system configurations, such as those explained below, may be suitable for the methods described in the present disclosure. The FCC unit 40 may generally comprise multiple components, such as an FCC reactor 44 and a catalyst regeneration unit 46. As used in the present disclosure in the context of FIG. 4, the FCC reactor 44 generally refers to a unit of the FCC unit 40 in which the major process reaction takes place, such as the upgrading of a hydrocarbon feed to form light olefins through contact with a cracking catalyst. The FCC reactor 44 may include a reaction zone 442, a separation zone 444, and a stripper zone 446. As used in the context of FIG. 4, the FCC unit 40 may also include the catalyst regeneration unit 46 comprising at least one regeneration zone 462 for regenerating spent catalyst.

A hydrocarbon feed 411, such as the cyclization effluent 32, the supplemental FCC feed, or a combination of both, may be introduced through a downer portion of the FCC unit 40 to the reaction zone 442 with steam or other suitable gas for atomization of the feed (not shown). An effective amount of heated fresh or regenerated FCC catalyst composition particles from regeneration zone 462 may be conveyed to the top of the reaction zone 442. The heated fresh or hot regenerated FCC catalyst composition particles from regeneration zone 462 may be conveyed to the top of the reaction zone 442 through a conduit 47, commonly referred to as a transfer line or standpipe, to a withdrawal or hopper (not shown) at the top of the reaction zone 442. The flow of hot FCC catalyst composition particles may typically be allowed to stabilize in order to be uniformly directed into the mix zone or feed injection portion of the reaction zone 442. The hydrocarbon feed 411 may be injected into a mixing zone through feed injection nozzles typically situated proximate to the point of introduction of the regenerated FCC catalyst composition particles into reaction zone 442. These multiple injection nozzles may result in the FCC catalyst composition particles and hydrocarbon feed 411 mixing thoroughly and uniformly. Once the hydrocarbon feed 411 contacts the hot FCC catalyst composition particles, a catalytic reaction may begin.

The reaction vapor of hydrocarbon products may flow through the remainder of the reaction zone 442 and into separation zone 444. Hydrocarbon products and unreacted hydrocarbons may be directed to various product recovery sections. In embodiments, if necessary for temperature control, a quench injection (not shown) can be provided near the bottom of the reaction zone 442 or immediately before the separation zone 444. This quench injection may quickly reduce or stop the catalytic reaction.

The reaction temperature (which may be equivalent to the outlet temperature of the FCC unit 410) may be controlled by opening and closing a catalyst slide valve (not shown) that may control the flow of regenerated FCC catalyst composition particles from the regeneration zone 462 into the top of the reaction zone 442.

The stripper zone 446 may also be present for separating the FCC catalyst composition particles from the hydrocarbon products and unreacted hydrocarbons. The FCC catalyst composition particles from separation zone 444 may pass to the stripper zone 446. In the stripper zone 446, a suitable stripping gas, such as steam, may be introduced through streamline 41. The stripper zone 446 may comprise a plurality of baffles or structured packing (not shown) over which downwardly flowing catalyst particles passes countercurrently to the stripping gas. The upwardly flowing stripping gas may strip or remove any additional hydrocarbons that remain in the catalyst particle pores or between catalyst particles. The stripped or spent FCC catalyst composition particles may be passed from the stripper zone 446 via conduit 43 to the catalyst regeneration unit 46. The stripped or spent FCC catalyst composition particles may be transported by lift forces from a combustion air stream 45 through a lift riser of the catalyst regeneration unit 46. The stripped or spent FCC catalyst composition particles may then be contacted with additional combustion air and undergo controlled combustion of any accumulated coke in the regeneration zone 462. Flue gasses may be removed from the regeneration zone 462 via conduit 49. In the regenerator, the heat produced from the combustion of any coke by-product may be transferred to the FCC catalyst composition particles, which may increase the temperature required to provide heat to the catalytic reaction in the reaction zone 442.

Referring now to FIG. 4, the FCC unit 400 may include a riser portion 412, a reaction zone 414, and a separation zone 416. The FCC unit 400 may also comprise a regeneration zone 462 for regenerating spent catalyst.

A hydrocarbon feed 411, such as the cyclization effluent 32, supplemental FCC feed 34, or a combination of both may be introduced to the reaction zone 414 with steam or other suitable gas for atomization of the feed (not shown). The hydrocarbon feed 411 may be admixed and contacted with an effective quantity of heated fresh or regenerated catalyst particles. The heated fresh or regenerated catalyst particles may be conveyed via a conduit 423 from the regeneration zone 462. The hydrocarbon feed 411 and the cracking catalyst may be contacted and then passed into the reaction zone 414. In a continuous process, the mixture of the cracking catalyst composition and hydrocarbon feed 411 may proceed upward through the riser portion 412 into reaction zone 414. In the riser portion 412 and the reaction zone 414, the hydrocarbons from the hydrocarbon feed 411 may be contacted with the cracking catalyst at reaction conditions. Contact of the hydrocarbons from the hydrocarbon feed 411 with the cracking catalyst at the reaction conditions may cause at least a portion of the hydrocarbons to react and undergo cracking reactions to form upgraded hydrocarbons, which may include light olefins such as but not limited to ethylene, propylene, butenes, or combinations of these.

During the reaction, the cracking catalyst may become coked, which may result in limited or non-existent access to the active catalytic sites of the cracking catalyst. Reaction products may be separated from the coked catalyst particles using any suitable configuration known in the art. This separation may occur in the zone generally referred to as the separation zone 416, which may be located above the reaction zone 414. The reaction product may be withdrawn via conduit 42. Cracking catalyst containing coke deposits from the reaction may be pass through conduit 415 to the regeneration zone 462.

In the regeneration zone 462, the coked cracking catalyst may come into contact with a stream of oxygen-containing gas, which may enter the regeneration zone 462 via conduit 45. The regeneration zone 462 may be operated in a configuration under conditions that are known in FCC operations. For instance, the regeneration zone 462 may be operated as a fluidized bed to produce regeneration off-gas comprising combustion products, which may be discharged via conduct 49. The hot regenerated FCC catalyst composition particles may be transferred from the regeneration zone 462 of the catalyst regeneration unit 46 via conduit 423 to the bottom portion of the riser portion 412 for admixture with the hydrocarbon feed 411 as noted above.

The cracking catalyst in the FCC reactor 44 may include any conventional or yet to be developed cracking catalyst. For example, similar to the cyclization catalyst 35, the cracking catalyst in the FCC reactor 44 of the FCC unit 40 may include a catalyst support material made of an ultra-stable Y-type (USY) zeolite. The USY zeolite may be a framework-substituted zeolite, in which a part of aluminum atoms constituting the zeolite framework are substituted with zirconium atoms, hafnium atoms, or a combination of zirconium atoms and hafnium atoms. The cracking catalyst in the FCC reactor 44 can further include an acidic component being at least one member of the group consisting of amorphous silica-alumina, zeolite, and combinations thereof. For example, the cracking catalyst in the FCC reactor 44 may be a catalyst described in U.S. Pat. No. 9,221,036 B2. In embodiments, the cracking catalyst in the FCC reactor 44 may not include an active phase metal. The acidity of the zeolite alone may be sufficient to promote the cracking reactions.

Referring again to FIG. 1, the FCC reactor 44 may contact the cyclization effluent 32, the supplemental FCC feed 34, or both with the cracking catalyst at operating conditions sufficient to cause at least a portion of the hydrocarbons in the cyclization effluent 32, the supplemental FCC feed 34, or both to undergo cracking to produce the FCC effluent 42. The FCC reactor 44 may be operated at an operating temperature in the range of from 450° C. to 700° C., such as from 550° C. to 700° C. or from 650° C. to 700° C., and an operating pressure of from 0.1 MPa (1 bar) to 1 MPa (10 bar), such as from 0.3 MPa (3 bar) to 1 MPa (10 bar) or from 0.5 MPa (5 bar) to 1 MPa (10 bar). The feed to the FCC reactor 44 may be contacted with the cracking catalyst at operating conditions for a residence time (the total time that the feed spends in contact with the cracking catalyst) from 0.1 seconds to 60 seconds, such as from 10 seconds to 60 seconds or from 30 seconds to 60 seconds. The feed to the FCC reactor 44 may be contacted with the cracking catalyst at a hydrocarbon feed to cracking catalyst mass ratio from 1:2 to 1:30, such as from 1:1 to 1:15, from 1:1 to 1:10, or from 1:8 to 1:20. In embodiments, the FCC unit 40 may operate as a high severity FCC unit 40. In high-severity operations, the FCC reactor 44 may operate at temperatures of from 600° C. to 700° C., a cracking catalyst to hydrocarbon feed ratio greater than 6:1, and a residence time of less than 3 seconds.

Contacting the cyclization effluent 32, the supplemental FCC feed 34, or a combination of both with the cracking catalyst at the operating conditions of the FCC reactor 44 may cause at least a portion of light paraffinic compounds in the cyclization effluent 32, the supplemental FCC feed 34, or a combination of both to undergo cracking reactions to form the FCC effluent 42. The FCC effluent 42, as compared to the cyclization effluent 32, the supplemental FCC feed 34, or combinations of both, may comprise increased concentrations of one or more of gasoline, light cycle oil (LCO), heavy cycle oil (HCO), total gas ($C_4$ and lighter), dry gas ($C_2$ and lighter), liquefied petroleum gas ($C_3$-$C_4$), ethylene, propylene, and butenes. The FCC effluent 42 may comprise gasoline blending components.

The FCC reactor 44 may be in fluid communication with the FCC separation unit 60 to pass the FCC effluent 42 from the FCC reactor 44 to FCC separation unit 60. The FCC separation unit 60 may be disposed downstream of the FCC reactor 44 of the FCC unit 40. The FCC separation unit 60 may be in fluid communication with the FCC reactor 44 of the FCC unit 40 and may receive all or at least a portion of the FCC effluent 42. The FCC separation unit 60 may include one or a plurality of separation units. The FCC separation unit 60 may be operable to separate the FCC effluent 42 into at least one light gas fraction 62, a light naphtha recycle fraction 64, an aromatic containing effluent 66, and a light olefin fraction 68. The FCC separation unit 60 may be operable to separate the FCC effluent 42 by distillation into at least the light gas fraction 62, the light naphtha recycle fraction 64, the aromatic containing effluent 66, and the light olefin fraction 68. In embodiments, the FCC separation unit 60 may include one or a plurality of distillation columns.

The light gas fraction 62 may comprise hydrogen, methane, and any other light gases. The light gas fraction 62 may include at least 80%, at least 90%, at least 95%, at least 98%, or even at least 99% of the light gases from the FCC effluent 42.

The light olefin fraction 68 may comprise $C_2$-$C_4$ olefins, such as ethylene, propene, butene, or combinations of these. The light olefin fraction 68 may include at least 80%, at least 90%, at least 95%, at least 98%, or even at least 99% of the ethylene, propene, and butene of the FCC effluent 42.

The light naphtha recycle fraction 64 $C_5$-$C_6$ hydrocarbons, such as $C_5$-$C_6$ paraffins that were not upgraded in the FCC unit 40. The light naphtha recycle fraction 64 may include at least 80%, at least 90%, at least 95%, at least 98%, or at least 99% by weight of the $C_5$-$C_6$ hydrocarbons from the FCC effluent 42. The light naphtha recycle fraction 64 may include at least 80%, at least 90%, at least 95%, at least 98%, or even at least 99% of the constituents of the FCC effluent 42 having boiling point temperatures ranging from 30° C. to 90° C. The light naphtha recycle fraction 64 may be passed back to the FCC unit 40 and processed again in the FCC unit 40. The light naphtha recycle fraction 64 may be combined with the cyclization effluent 32 upstream of the FCC unit 40. Alternatively, the light naphtha recycle fraction 64 may be passed to the FCC unit 40, either directly or with intermediate process steps. For example, a portion of the light naphtha recycle fraction 65 may be purged prior to the light naphtha recycle fraction 64 being combined with the cyclization effluent 32 or being passed to the FCC unit 40.

The aromatic containing effluent 66 $C_{7+}$ hydrocarbons. The aromatic containing effluent 66 may include at least 80%, at least 90%, at least 95%, at least 98%, or at least 99% by weight of the $C_{7+}$ hydrocarbons from the FCC effluent 42. The aromatic containing effluent 66 may include at least 80%, at least 90%, at least 95%, at least 98%, or even at least 99% of the constituents of the FCC effluent 42 having boiling point temperatures ranging greater than 90° C. The aromatic containing effluent 66 may comprise the remaining portion of the FCC effluent 42 not encompassed by the light gas fraction 62, the light naphtha recycle fraction 64, and the light olefin fraction 68. The aromatic containing effluent 66 may be passed to the aromatic recovery complex 70 for further processing or to the gasoline pool 80, which are described in greater detail below.

Referring again to FIG. 1, the heavy naphtha fraction 24 may be passed to a naphtha reforming unit 50. The naphtha reforming unit 50 may be in fluid communication with the naphtha separation unit 20 and may receive the heavy naphtha fraction 24 from the naphtha separation unit 20. The heavy naphtha fraction 24 may be passed directly from the naphtha separation unit 20 to the naphtha reforming unit 50 without passing through any intervening reactor or separation system. The naphtha reforming unit 50 may be operable reform the heavy naphtha fraction 24 to produce a naphtha reformate 52. The naphtha reforming unit 50 may also produce a separate hydrogen effluent 54. The naphtha reforming unit 50 may include a reformed effluent separation system (not shown) that may be operable to separate an effluent from the reforming reactor into the naphtha reformate 52 and the hydrogen effluent 54. The hydrogen effluent 54 may be recovered or may be recycled back to one or more of the desulfurization unit 10, the cyclization unit 30, or both as at least a portion of the hydrogen streams to those units.

The heavy naphtha fraction 24 may be passed to the naphtha reforming unit 50 to upgrade the heavy naphtha fraction 24 to improve its quality, such as by increasing the octane number to produce the naphtha reformate 52 that can be used as a gasoline blending stream 53 or feedstock for an aromatic recovery complex 70. The gasoline pool 80 may include $C_4$ and heavier hydrocarbons having atmospheric boiling points of less than 205° C. The naphtha reforming unit 50 may be a catalytic reforming process. In catalytic reforming processes, paraffins and naphthenes can be restructured to produce isomerized paraffins and aromatics of relatively higher octane numbers. Catalytic reforming can convert low octane n-paraffins to i-paraffins and naphthenes. Naphthenes can then be converted to higher octane aromatic compounds. The aromatic compounds present in the heavy naphtha fraction 24 can remain unchanged or at least a portion of aromatic compounds from the heavy naphtha fraction 24 may be hydrogenated to form naphthenes by reverse reactions taking place in the presence of hydrogen. The hydrogen may be generated during reforming of other constituents in the reforming unit and may be present in the reaction mixture.

The chemical reactions involved in catalytic reforming can be grouped into four categories, which include cracking, dehydrocyclization, dehydrogenation, and isomerization. A particular hydrocarbon molecule of the heavy naphtha fraction 24 may undergo one or more than one category of reaction during the reforming process to form one or a plurality of different molecules or products.

The naphtha reforming unit 50 may contact the heavy naphtha fraction 24 with a reforming catalyst under operating conditions sufficient to cause at least a portion of the heavy naphtha fraction 24 to undergo one or more reactions to produce a reforming effluent, which may then be separated into the naphtha reformate 52 and the hydrogen effluent 54. The naphtha reforming unit 50 may be operated at a temperature of from 400° C. to 560° C., or from 450° C. to 560° C. The naphtha reforming unit 50 may be operated at a pressure of from 100 kilopascals (kPa) to 5,000 kPa (from 1 bar to 50 bar), or from 100 kPa to 2,000 kPa (from 1 bar to 20 bar). The naphtha reforming unit 50 may be operated at a liquid hourly space velocity (LHSV) of from 0.5 per hour ($hr^{-1}$) to 4 $h^{-1}$, or from 0.5 $h^{-1}$ to 2 $h^{-1}$.

The reforming catalysts for catalytic reforming processes in the naphtha reforming unit 50 can be either monofunctional or bi-functional reforming catalysts, which can contain precious metals, such as one or more metals from Groups 8-10 of the IUPAC periodic table, as active components (Group VIIIB in the Chemical Abstracts Services (CAS) system). The metals may be supported on a catalyst support, such as but not limited to an alumina, silica, titania, or combination of these supports. The reforming catalyst can be a bi-functional catalyst that has both metal sites and acidic sites. The reforming catalyst may be a platinum or palladium supported on an alumina support. The composition of the heavy naphtha fraction 24, the impurities present in the heavy naphtha fraction 24, and the desired products in the naphtha reformate 52 may influence the selection of reforming catalyst, reforming process type, and operating conditions. Types of chemical reactions can be targeted by a selection of catalyst or operating conditions known to those of ordinary skill in the art to influence both the yield and selectivity of conversion of paraffinic and naphthenic hydrocarbon precursors to particular aromatic hydrocarbon structures.

The naphtha reforming unit 50 may be any one of several types of catalytic reforming process configurations, which differ in the manner in which they regenerate the reforming catalyst to remove the coke formed during the reforming process. Catalyst regeneration, which involves combusting detrimental coke in the presence of oxygen, can include a semi-regenerative process, a cyclic regeneration process, or continuous regeneration process. Semi-regeneration is the simplest configuration, and the entire unit, including all reactors in the series, are shut-down for catalyst regeneration in all reactors. Cyclic configurations utilize an additional "swing" reactor to permit one reactor at a time to be taken off-line for regeneration while the others remain in service. Continuous catalyst regeneration configurations, which are the most complex, provide for continuous operation by catalyst removal, regeneration and replacement. While continuous catalyst regeneration configurations may enable the severity of the operating conditions to be increased due to higher catalyst activity, the associated capital investment is necessarily higher.

Referring now to FIG. 2, the system 100 for upgrading a naphtha feed 2 may include the desulfurization unit 10 disposed upstream of the naphtha separation unit 20. The naphtha feed 2 may include small amounts of sulfur compounds depending on the source of the naphtha feed 2. These sulfur compounds may cause deactivation of catalysts in the cyclization unit 30, the FCC unit 40, the naphtha reforming unit 50, or combinations of these. The desulfurization unit 10 may be operable to remove at a portion of or all of these sulfur compounds, which may reduce deactivation of the catalysts in the system 100.

The naphtha feed 2 may be passed to the desulfurization unit 10 prior the naphtha feed 2 being passed to the naphtha separation unit 20. The desulfurization unit 10 may be operable to contact at least a portion of the naphtha feed 2 with hydrogen 4 in the presence of a desulfurization catalyst 15 to produce the desulfurized naphtha feed 12. The hydrogen 4 may include recycled hydrogen, such as a portion of hydrogen effluent 54 from the naphtha reforming unit 50, a portion of excess hydrogen from the desulfurization unit 10, or a portion of excess hydrogen recovered from the cyclization unit 30 (either immediately after the cyclization unit 30 or downstream of the FCC unit 40) or supplemental hydrogen from an external hydrogen source inside or outside the battery limits of the refinery. The hydrogen 4 may be passed directly to the desulfurization unit 10 or may be combined with the naphtha feed 2 upstream of the desulfurization unit 10.

The desulfurization unit 10 may include may include any type of reactor suitable for contacting the naphtha feed 2 with hydrogen 4 in the presence of the desulfurization catalyst 15. Suitable reactors may include, but are not limited to, fixed bed reactors, moving bed reactors, fluidized bed reactors, plug flow reactors, other type of reactor, or combinations of reactors. The desulfurization unit 10 may include one or more fixed bed reactors, which may be operated in downflow, upflow, or horizontal flow configurations.

The desulfurization catalyst 15 in the desulfurization unit 10 may include a hydrodesulfurization catalyst (HDS catalyst) comprising one or more metals from Group 6 and one metal from Groups 6-10 of the IUPAC periodic table, which may be present as metals, metal oxides, or metal sulfides, supported on the support material. The HDS catalyst may comprise nickel, molybdenum, cobalt, or combinations of these. The HDS catalyst may also contain a dopant that is selected from the group consisting of boron, phosphorus, halogens, silicon, and combinations thereof.

The desulfurization unit 10 may contact the naphtha feed 2 with hydrogen 4 in the presence of the desulfurization catalyst 15 at operating conditions sufficient to cause at least a portion of the sulfur components in the naphtha feed 2 to be removed to produce a desulfurized naphtha feed 12. The desulfurization unit 10 may be operated at an operating temperature in the range of from 200° C. to 400° C., such as from 250° C. to 350° C. or from 275° C. to 325° C., and an operating pressure of from 1 MPa (10 bar) to 5 MPa (50 bar), such as from 1 MPa (10 bar) to 4 MPa (40 bar) or from 1 MPa (120 bar) to 3 MPa (30 bar). The feed rate of hydrogen 4 to the desulfurization unit 10 may be from 50 to 300 standard liters per liter of feed (SLt/Lt) to the desulfurization unit 10, where the feed can be the naphtha feed 2. The desulfurization unit 10 may operate at a liquid hourly space velocity (LHSV) of from 1 per hour to 15 per hour, such as from 5 per hour to 15 per hour or from 7 per hour to 12 per hour.

Contacting the naphtha feed 2 with hydrogen 4 in the presence of the desulfurization catalyst 15 at the operating conditions of the desulfurization unit 10 may cause at least a portion of sulfur components in the naphtha feed 2 to be removed. The desulfurized naphtha feed 12 may comprise less than 0.5 parts per million by weight (ppmw) of sulfur components. Similarly, contacting the naphtha feed 2 with hydrogen in the presence of the desulfurization catalyst 15 at the operating conditions of the desulfurization unit 10 may cause at least a portion of nitrogen components in the naphtha feed 2 to be removed. The desulfurized naphtha feed 12 may comprise less than 0.5 ppmw of nitrogen components. The desulfurization unit 10 may be in fluid communication with the naphtha separation unit 20 to pass the desulfurized naphtha feed 12 from the desulfurization unit 10 to the naphtha separation unit 20. The desulfurized naphtha feed 12 may be processed in the naphtha separation unit 20 in the same manner as the naphtha feed 2, as previously described in relation to FIG. 1.

The system 100 depicted in FIG. 2 may also include the naphtha separation unit 20, the cyclization unit 30, the FCC unit 40, the naphtha reforming unit 50, and the FCC separation unit 60, as previously discussed in the present disclosure. The naphtha separation unit 20 may be disposed downstream of the desulfurization unit 10 and upstream of the cyclization unit 30 and naphtha reforming unit 50. The naphtha separation unit 20 may be operable to separate a desulfurized naphtha feed 12 into at least the light naphtha fraction 22 and the heavy naphtha fraction 24. The naphtha separation unit 20 may have any of the features or operating conditions previously described in the present disclosure for the naphtha separation unit 20. The cyclization unit 30 may be disposed downstream of the naphtha separation unit 20 and upstream of the FCC unit 40. The cyclization unit 30 may be operable to contact the light naphtha fraction 22 with hydrogen 26 in the presence of the cyclization catalyst 35 to produce the cyclization effluent 32. The cyclization unit 30 may have any of the features, catalysts, or operating conditions previously described in the present disclosure for the cyclization unit 30.

The FCC unit 40 may include the FCC reactor 44 and the catalyst regeneration unit 46. The FCC unit 40 may be disposed downstream of the cyclization unit 30 and upstream of the FCC separation unit 60. The FCC unit 40 may be operable to contact the cyclization effluent 32, the supplemental FCC feed 34, or both with the cracking catalyst to produce the FCC effluent 42. The FCC reactor 44 and the catalyst regeneration unit 46 of the FCC unit 40 may have any of the features, catalysts, or operating conditions previously described in the present disclosure for the FCC reactor 44 and the catalyst regeneration unit 46, respectively, of the FCC unit 40.

The naphtha reforming unit 50 may be disposed downstream of the naphtha separation unit 20 and upstream of the aromatic recovery complex 70 and the gasoline pool 80. The naphtha reforming unit 50 may be operable to reform the heavy naphtha fraction 24 to produce the naphtha reformate 52. The naphtha reforming unit 50 may have any of the features or operating conditions previously described in the present disclosure for the naphtha reforming unit 50.

The FCC separation unit 60 may be disposed downstream of the FCC reactor 44 of the FCC unit 40 and upstream of the aromatic recovery complex 70 and the gasoline pool 80. The naphtha reforming unit 50 may be operable to separate the FCC effluent 42 into at least the light gas fraction 62, the light naphtha recycle fraction 64, the aromatic containing effluent 66, and the light olefin fraction 68. The FCC separation unit 60 may have any of the features or operating conditions previously described in the present disclosure for the FCC separation unit 60.

Referring still to FIG. 2, the system 100 may include an aromatic recovery complex 70 disposed downstream of the FCC separation unit 60 and the naphtha reforming unit 50. The aromatic recovery complex 70 may be in fluid communication with the FCC separation unit 60 and may receive all or at least a portion of the aromatic containing effluent 66 from the FCC separation unit 60. The aromatic containing effluent 66 may be the gasoline fraction of the FCC effluent 42, the gasoline fraction comprising constituents of the FCC effluent 42 that may be suitable for use in gasoline blending. The aromatic recovery complex 70 may also be in fluid communication with the naphtha reforming unit 50 and may receive all or at least a portion of the naphtha reformate 52 from the naphtha reforming unit 50. The aromatic recovery complex 70 may process the aromatic containing effluent 66 and the naphtha reformate 52 to produce at least one aromatic product effluent 72, a gasoline pool stream 74, and an aromatic bottoms stream 76. The aromatic recovery complex 70 may be operable to separate the aromatic containing effluent 66 and the naphtha reformate 52 into the at least one aromatic product effluent 72, a gasoline pool stream 74, and the aromatic bottoms stream 76. The aromatic recovery complex 70 may also be operable to convert one or more aromatic compounds in the aromatic containing effluent 66 and the naphtha reformate 52 to other aromatic compounds, such as xylenes or other gasoline pool components.

In the aromatic recovery complex 70, the aromatic containing effluent 66 and the naphtha reformate 52 may be subjected to several processing steps to recover greater value products, such as xylenes and benzene, and to convert lower value products, such as toluene, into greater value products. For example, the aromatic compounds present in the aromatic containing effluent 66 naphtha reformate 52 can be separated into different fractions by carbon number, such as but not limited to a $C_5$-fraction, a $C_6$ fraction comprising benzene, a $C_7$ fraction comprising toluene, a $C_8$ fraction including xylenes, and ethylbenzene, and a $C_{9+}$ fraction (aromatic bottoms stream 76 ). The $C_8$ fraction may be subjected to one or more operations to convert ethylbenzene, ortho-xylene, and meta-xylene to produce greater yield of para-xylene, which is of greater value. Para-xylene can be recovered in high purity from the $C_8$ fraction by separating the para-xylene from the ortho-xylene, meta-xylene, and ethylbenzene using selective adsorption or crystallization. The ortho-xylene and meta-xylene remaining from the para-xylene separation can be isomerized to produce an equilibrium mixture of xylenes. The ethylbenzene can be isomerized into xylenes or can be dealkylated to benzene and ethane. The para-xylene can then be separated from the ortho-xylene and the meta-xylene using adsorption or crystallization, and the para-xylene-depleted-stream can be recycled to extinction to the isomerization unit and then to the para-xylene recovery unit until all of the ortho-xylene and meta-xylene are converted to para-xylene and recovered.

Toluene can be recovered as a separate fraction, such as a $C_7$ fraction, and then can be converted into greater value products, such as but not limited to benzene or xylenes. One toluene conversion process can include the disproportionation of toluene to make benzene and xylenes. Another toluene conversion process can include the hydrodealkylation of toluene to make benzene. Another toluene conversion process can include the transalkylation of toluene to make benzene and xylenes. Both toluene disproportionation and toluene hydrodealkylation can result in the formation of benzene.

Figure 5:
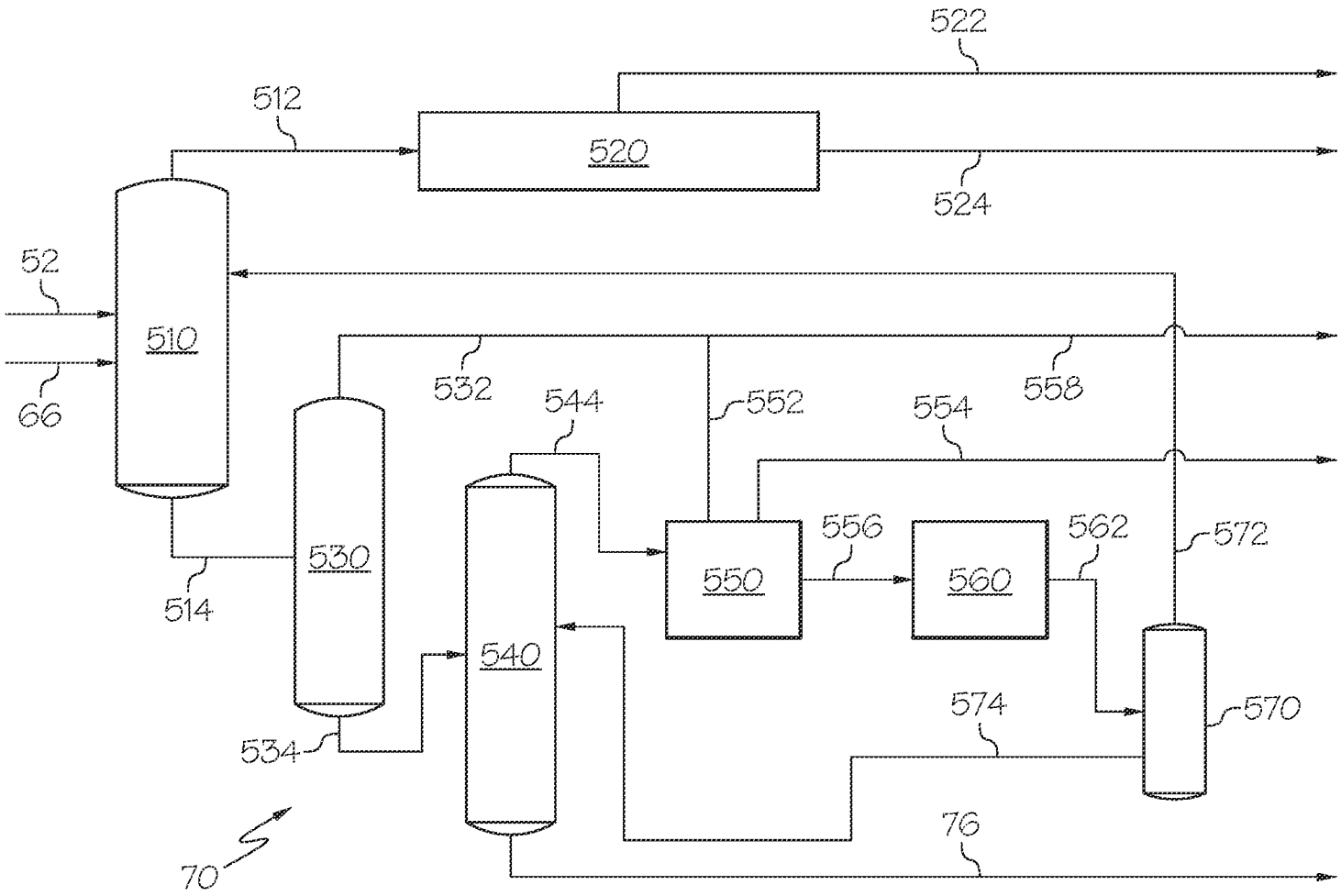
FIG. 5 schematically depicts a generalized flow diagram of an aromatics recovery unit (ARC) of the system of FIG. 2, according to one or more embodiments shown and described in this disclosure.

Referring to FIG. 5, an embodiment of the aromatic recovery complex 70 is schematically depicted. The naphtha reformate 52 from the naphtha reforming unit 50 (FIG. 2) and the aromatic containing effluent 66 from the FCC separation unit 60 (FIG. 2) can be passed to a reformate splitter 510 that can separate the naphtha reformate 52 and aromatic containing effluent 66 into two fractions: a light reformate stream 512 comprising $C_5$-$C_6$ hydrocarbons, and a heavy reformate stream 514 comprising $C_{7+}$ hydrocarbons. In embodiments, the naphtha reformate 52, the aromatic containing effluent 66, or both may be hydrotreated (not shown) prior to being passed to the aromatic recovery complex. Hydrotreating the naphtha reformate 52, the aromatic containing effluent 66, or both may remove mono-olefins, diolefins, or both before the naphtha reformate 52, the aromatic containing effluent 66, or both are passed to the aromatic recovery complex 70. The light reformate stream 512 may be passed to a benzene extraction unit 520, which may extract the benzene as benzene product in benzene stream 524 and recover substantially benzene-free gasoline in raffinate motor gasoline (mogas) stream 522. The heavy reformate stream 514 may be passed to a splitter 530 which may separate the heavy reformate stream 514 to produce a $C_7$ mogas stream 532 and a $C_{8+}$ hydrocarbon stream 534. The $C_{+8}$ hydrocarbon stream 534 may be passed to a clay tower (not shown) to remove olefin compounds from the $C_{8+}$ hydrocarbon stream 534.

Still referring to FIG. 5, the $C_{8+}$ hydrocarbon stream 534 may be passed to a xylene rerun unit 540, which may separate the $C_{8+}$ hydrocarbon stream 534 into a $C_8$ hydrocarbon stream 544 and the aromatic bottoms stream 76, which is a $C_{9+}$ hydrocarbon stream comprising $C_{9+}$ hydrocarbons. $C_8$ hydrocarbon stream 544 may be passed to a para-xylene recovery unit 550 that may recover para-xylene as para-xylene product stream 554. The para-xylene recovery unit 550 may also produce a $C_7$ cut mogas stream 552, which may be combined with the $C_7$ cut mogas stream 532 from splitter 530 to produce $C_7$ cut mogas stream 558 as the at least one aromatic product effluent 72 (FIG. 2). Other xylenes (meta-xylene, ortho-xylene, and any trace para-xylene not passed out of the para-xylene recovery unit 550 in the para-xylene product stream 554) may be recovered and passed to a xylene isomerization unit 560 through mixed xylene stream 556. The xylene isomerization unit 560 may isomerize at least a portion of ortho-xylene, meta-xylene, or both, in the mixed xylene stream 556 to para-xylene. The isomerization effluent 562 may be passed from the xylene isomerization unit 560 to a splitter column 570, which may separate the isomerization effluent 562 into a splitter top stream 572 and a splitter bottoms stream 574. The splitter bottoms stream 574 may include the para-xylene produced in the xylene isomerization unit 560 as well as the remaining ortho-xylene and meta-xylene. The splitter bottoms stream 574 may be passed back to the xylene rerun unit 540 so that the xylenes can be separated and passed to the para-xylene recovery unit 550 for further recovery ofpara-xylene. The splitter top stream 572 may be recycled back to reformate splitter 510.

The raffinate mogas stream 522 may be passed out of the aromatic recovery complex 70 as the gasoline pool stream 74 (FIG. 2), which may be passed to the gasoline pool 80 for blending into fuels. The gasoline pool stream 74 comprising the raffinate mogas stream 522 may have less than or equal to 3 volume percent benzene, or less than or equal to 1 volume percent benzene. The aromatic bottoms stream 76 (FIG. 2) passed out of the aromatic recovery complex 70 may include one or more of the benzene stream 524, the para-xylene product stream 554, the $C_7$ cut mogas stream 558, or combinations of these. The aromatic bottoms stream 76 may include the $C_9$+aromatic compounds from the xylene rerun unit 540 of the aromatic recovery complex 70. The aromatic bottoms stream 76 may include the heavier fraction, such as $C_{9+}$ alkylated mono-aromatics, and may be a more complex mixture of compounds including di-aromatics. The aromatic bottoms stream 76 may include $C_{9+}$ aromatic compounds having an atmospheric boiling temperature in a range of from 150° C. to 350° C. Since olefins are detrimental in the extraction/adsorption process within the aromatic recovery complex 70, olefin compounds can be removed using a clay tower or selective hydrogenation. As previously discussed, the $C_{8+}$ hydrocarbon stream 534 from the splitter 530 may be passed to a clay tower (not shown) to remove olefin compounds from the $C_{8+}$ hydrocarbon stream 534. Due to the acidic nature of the clays, olefinic aromatics such as styrene can react with other aromatic molecule via an alkylation reaction to form bridged di-aromatic molecules. These di-aromatic molecules can end up in the aromatic bottoms stream 76.

Referring again to FIG. 2, the system 100 may include a gasoline pool 80 disposed downstream of the naphtha reformate unit 50 and the FCC separation unit 60. All or a portion of the naphtha reformate 52 may be passed to the gasoline pool 80 via stream 53 for inclusion into various fuel products. Additionally or alternatively, all or a portion of the aromatic containing effluent 66 may be passed to the gasoline pool 80 via stream 67 for inclusion into various fuel products. Additionally or alternatively, all or a portion of the gasoline pool stream 74 from the aromatic recovery complex 70 may be passed to the gasoline pool 80 for inclusion into various fuel products. The gasoline effluent may comprise an octane number greater than 100.

Referring again to FIGS. 1-2, a process for upgrading the naphtha feed 2 may include separating the naphtha feed 2 into at least the light naphtha fraction 22 and the heavy naphtha fraction 24. The process for upgrading the naphtha feed 2 further includes contacting the light naphtha fraction 22 with hydrogen 26 in the presence of at least one cyclization catalyst 35 to produce the cyclization effluent 32. The cyclization effluent 32 comprises a greater concentration of naphthenes compared to the light naphtha fraction 22. The process for upgrading the naphtha feed 2 further includes contacting the cyclization effluent 32 with at least one cracking catalyst under conditions sufficient to crack at least a portion of the cyclization effluent 32 to produce the FCC effluent 42. The FCC effluent 42 comprises light olefins, gasoline blending components, or both.

Still referring to FIGS. 1-2, another process for separating and upgrading the naphtha feed 2 may include passing the naphtha feed 2 to the naphtha separation unit 20 that separates the naphtha feed 2 into at least the light naphtha fraction 22 and the heavy naphtha fraction 24. The naphtha separation unit 20 may have any of the features or operating conditions previously discussed in this disclosure for the naphtha separation unit 20. The process for separating and upgrading the naphtha feed 2 further includes passing the light naphtha fraction 22 to the cyclization unit 30 that contacts the light naphtha fraction 22 with hydrogen 26 in the presence of at least one cyclization catalyst 35 to produce the cyclization effluent 32. The cyclization unit 30 may have any of the features, catalysts, or operating conditions previously discussed in this disclosure for the cyclization unit 30. The cyclization effluent 32 comprises a greater concentration of naphthenes compared to the light naphtha fraction 22. The process for separating and upgrading the naphtha feed 2 further includes passing the cyclization effluent 32 to the FCC unit 40 that contacts the cyclization effluent 32 with at least one cracking catalyst under conditions sufficient to crack at least a portion of the cyclization effluent 32 to produce the FCC effluent 42. The FCC unit 40 may have any of the features, catalysts, or operating conditions previously discussed in this disclosure for the FCC unit 40. The FCC effluent 42 comprises light olefins, gasoline blending components, or both.

The process for separating and upgrading the naphtha feed 2 may further include passing the naphtha feed 2 to the desulfurization unit 10 that contacts the naphtha feed 2 with hydrogen 4 in the presence of the desulfurization catalyst 15. The desulfurization unit 10 may have any of the features, catalysts, or operating conditions previously discussed in this disclosure for the desulfurization unit 10.

The process for separating and upgrading the naphtha feed 2 may further include passing the aromatic containing effluent 66 to the aromatic recovery complex 70 or gasoline pool 80. The aromatic recovery complex 70 and gasoline pool 80 may have any of the features or operating conditions previously discussed in this disclosure for the aromatic recovery complex 70 or the gasoline pool 80, respectively. The aromatic recovery complex 70 may produce benzene, toluene, xylene, or combinations of these. Gasoline from the gasoline pool 80 may have an octane number greater than 100.

The process for separating and upgrading the naphtha feed 2 may further include passing the naphtha reformate 52 to the aromatic recovery complex 70 or gasoline pool 80. The aromatic recovery complex 70 and gasoline pool 80 may have any of the features or operating conditions previously discussed in this disclosure for the aromatic recovery complex 70 or the gasoline pool 80, respectively.

EXAMPLES

The various embodiments of methods and systems for the processing of heavy oils will be further clarified by the following examples. The examples are illustrative in nature, and should not be understood to limit the subject matter of the present disclosure.

Example 1: Desulfurization of Naphtha Feed

A straight run naphtha feed from Arabian heavy crude oil was desulfurized over a desulfurization catalyst. The naphtha feed comprised a specific gravity of 0.76418 grams per cubic centimeter (g/cm$^3$) and a contained 184 ppmw of sulfur components. The desulfurization catalyst included Co—Mo as active phase materials on an alumina support. The naphtha feed was desulfurized at a temperature of 300° C., a hydrogen partial pressure of 2 MPa (20 bar), a hydrogen to naphtha feed ratio of 100 SLt/Lt, and a LHSV of 9.5 h$^{-1}$. The desulfurized naphtha feed comprised 0.5 ppmw of sulfur components and 0.5 ppmw of nitrogen components.

Example 2: Cyclization of Light Naphtha Fraction

A light naphtha fraction was processed in a cyclization unit over a cyclization catalyst to form a cyclization effluent. The light naphtha fraction was processed over a catalyst containing Ti-Zr modified USY zeolite and platinum as active phase metal at a temperature of 475° C., a hydrogen partial pressure of 0.3 MPa (3 bar), a molar ratio of hydrogen to light naphtha fraction of 3, and a LHSV of 4 h$^{-1}$. Table 1, shown below, summarizes the composition of both the light naphtha fraction and the cyclization effluent, which demonstrates an increased amount of naphthenes in the cyclization effluent.

TABLE 1

Light Naphtha Fraction and Cyclization Effluent

| Component | Light Naphtha Fraction (wt. %) | Cyclization Effluent (wt. %) |
|---|---|---|
| n-Paraffins | 26.4 | 11.6 |
| iso-Paraffins | 44.1 | 38.7 |
| Olefins | 0.0 | 0.4 |
| Naphthenes | 26.0 | 39.1 |
| Aromatics | 2.1 | 10.0 |
| Unidentified | 1.3 | 0.1 |

Example 3: Cracking of Cyclization Effluent

The cyclization effluent of Example 2 was cracked in a Micro Activity Test (MAT) unit (e.g., FCC unit) over an olefin selective cracking catalyst (USY). The cracking catalyst comprised 5 weight percent (wt. %) of cracking additive (MFI-type zeolite). The cyclization effluent was contacted with the cracking catalyst in the MAT unit at a temperature of 650° C., a pressure of 0.1 MPa (1 bar), a weight ratio of cracking catalyst to cyclization effluent feed of 6.11, and at a residence time of 30 seconds. Table 2, shown below, summarizes the composition of the processed light naphtha fraction.

TABLE 2

Light Naphtha Fraction and Cyclization Effluent

| Component | FCC Unit Effluent (wt. %) |
|---|---|
| $H_2$ and $C_1$-$C_4$ | 22.7 |
| $C_2$-$C_4$ Olefins | 35.0 |
| Gasoline | 41.0 |
| Coke* | 1.3 |

As compared with Table 1, Table 2 shows that the FCC unit effluent comprises an increased amount olefins. Table 2 also shows the almost 41 wt. % gasoline fraction. Table 2 also shows a 1.34 wt. % coke yield. The coke may be burned off within the FCC unit when the catalyst is regenerated.

Example 4: Reforming of Heavy Naphtha Fraction

A heavy naphtha fraction, which is separated from the light naphtha fraction, after the naphtha feed is desulfurized (Example 1), was processed over a reforming catalyst. The heavy naphtha fraction was contacted with the reforming catalyst in the naphtha reforming unit at a temperature of 540° C., a pressure of 0.8 MPa (8 bar), a molar ratio of hydrogen to heavy naphtha fraction feed of 7, and LHSV of 1 h$^{-1}$. Tables 3 and 4, shown below, summarize the composition and yield, respectively, of the naphtha reformate produced in the naphtha reforming unit. The naphtha reformate comprised a research octane number (RON) of 109 and a specific gravity of 0.8519 g/cm$^3$.

TABLE 3

Naphtha Reformate Composition

| Component | Heavy Naphtha Fraction (wt. %) | Naphtha Reformate (wt. %) |
|---|---|---|
| n-Paraffins | 37.7 | 2.0 |
| iso-Paraffins | 27.2 | 4.7 |
| Olefins | 2.6 | 0.00 |
| Naphthenes | 19.2 | 0.4 |
| Aromatics | 12.1 | 93.0 |
| Unidentified | 1.2 | (0.1) |

TABLE 4

Naphtha Reformate Yield

| Yield | Naphtha Reformate (wt. %) |
|---|---|
| $C_1$-$C_2$ | 2.8 |
| $C_3$-$C_4$ | 5.7 |
| $C_{5+}$ | 85.7 |
| $H_2$ | 5.1 |

Comparative Example 1: Isomerization Unit Instead of Cyclization Unit

In Comparative Example 1, each of Examples 1-4 was reproduced, except that in Example 2, the light naphtha fraction was processed in an isomerization unit instead of a cyclization unit and FCC unit. A light naphtha fraction was processed in an isomerization unit over an isomerization catalyst to form an isomerization effluent. The isomerization catalyst was chlorinated platinum supported on an alumina catalyst. The light naphtha fraction was contacted with the isomerization catalyst at a temperature of 135° C., a hydrogen partial pressure of 3.5 MPa (35 bar), a molar ratio of hydrogen to light naphtha fraction of 1:10, and a LHSV of 1.8 h$^{-1}$. Table 5, shown below, summarizes the composition of both the light naphtha fraction and the isomerization effluent.

TABLE 5

Light Naphtha Fraction and Isomerization Effluent

| Component | Light Naphtha Fraction (wt. %) | Isomerization Effluent (wt. %) |
|---|---|---|
| Paraffins | 26.4 | 8.8 |
| Isoparaffins | 44.1 | 61.0 |
| Olefins | 0.0 | 0.0 |
| Naphthenes | 26.0 | 26.0 |
| Aromatics | 2.1 | 2.1 |
| Unidentified | 1.3 | 0.0 |

Example 5: Material Balance of Examples 1-4 and Comparative Example 1

Table 6, shown below, sets forth a material balance of two different processes, the first corresponding to Examples 1-4, where the light naphtha fraction is processed in the cyclization unit prior to being passed to the FCC unit, and the second corresponding to Comparative Example 1, where the light naphtha fraction is instead processed in the isomerization unit prior to the FCC unit. The two different processes are considered within a 400 thousand barrel per day (MBPD) Arab light crude oil refinery. Table 6 also includes research octane numbers of various streams depicted in FIG. 2. In Table 6, it is assumed that all of the aromatic containing effluent 66 from the FCC unit 40 and all of the naphtha reformate 52 is passed to the gasoline pool.

TABLE 6

Flows and Research Octane Numbers of Streams in Ex. 1-4 and C. Ex. 5

| Stream Name (Stream # in FIG. 2) | Flow (MBPSD) (Ex. 1-4) | RON (Ex. 1-4) | Flow (MBPSD) (C. Ex. 5) | RON (C. Ex. 5) |
|---|---|---|---|---|
| Naphtha Feed (2) | 110.0 | 62 | 110.0 | 62 |
| Desulfurized Naphtha Feed (12) | 109.9 | | 109.9 | |
| Light Naphtha Fraction (22) | 27.5 | | 27.5 | |
| Heavy Naphtha Fraction (24) | 82.4 | | 82.4 | |
| Isomerization Effluent (Not Shown) | N/A | N/A | 27.4 | 82 |
| Cyclization Effluent (32) | 26.1 | 82 | N/A | N/A |
| Light Naphtha Recycle Fraction (64) | 11.7 | | N/A | |
| Light Olefin Fraction (68) | (12.9) | | N/A | |
| Aromatic Containing Effluent (66) | 10.7 | 105 | N/A | N/A |
| Naphtha Reformate (52) | 70.6 | 109 | 70.6 | 109 |
| Gasoline Pool (82) | 81.3 | 108 | 98.0 | 94 |

As shown in Table 6, when the isomerization unit is replaced with the cyclization unit, a higher quality gasoline, although a lower quantity, is produced. Replacing the isomerization unit with the cyclization unit may also produce an increased amount of light olefins and aromatics.

One or more aspects of the present disclosure are described herein. A first aspect of the present disclosure may include a process for separating and upgrading a naphtha feed, the process comprising: passing the naphtha feed to a naphtha separation unit that separates the naphtha feed into at least a light naphtha fraction and a heavy naphtha fraction; passing the light naphtha fraction to a cyclization unit that contacts the light naphtha fraction with hydrogen in the presence of at least one cyclization catalyst to produce a cyclization effluent comprising a greater concentration of naphthenes compared to the light naphtha fraction; and passing the cyclization effluent to a fluid catalytic cracking unit that contacts the cyclization effluent with at least one cracking catalyst under conditions sufficient to crack at least a portion of the cyclization effluent to produce a fluid catalytic cracking effluent comprising light olefins, gasoline blending components, or both.

A second aspect of the present disclosure may include the first aspect, further comprising passing the heavy naphtha fraction to a naphtha reforming unit that reforms the heavy naphtha fraction to produce a naphtha reformate.

A third aspect of the present disclosure may include the second aspect, further comprising passing a portion of the fluid catalytic cracking effluent, at least a portion of the naphtha reformate, or both to a gasoline pool.

A fourth aspect of the present disclosure may include the third aspect, where the gasoline comprises an octane number greater than 100.

A fifth aspect of the present disclosure may include the second aspect, further comprising passing a portion of the fluid catalytic cracking effluent, at least a portion of the naphtha reformate, or both to an aromatic recovery complex to produce benzene, toluene, xylene, or combinations of these.

A sixth aspect of the present disclosure may include the fifth aspect, where the portion of the fluid catalytic cracking effluent comprises gasoline blending components.

A seventh aspect of the present disclosure may include any one of the first through the sixth aspects, further comprising passing a supplemental FCC feed to the fluid catalytic cracking unit and contacting the supplemental FCC feed and the cyclization effluent with the at least one cracking catalyst to produce the fluid catalytic cracking effluent.

An eighth aspect of the present disclosure may include the seventh aspect, where the supplemental FCC feed comprises vacuum gas oil, demetallized oil, atmospheric residue, or combinations of these.

A ninth aspect of the present disclosure may include the eighth aspect, comprising combining the supplemental FCC feed with the cyclization effluent upstream of the fluid catalytic cracking unit.

A tenth aspect of the present disclosure may include any one of the first through the ninth aspects, further comprising contacting the naphtha feed with hydrogen in the presence of a desulfurization catalyst in a desulfurization unit prior to separating the naphtha feed into the light naphtha fraction and the heavy naphtha fraction, where the contacting causes at least a portion of sulfur components to be removed from the naphtha feed to produce a desulfurized naphtha feed.

An eleventh aspect of the present disclosure may include any one of the first through the tenth aspects, where the desulfurized naphtha feed comprises less than or equal to 0.5 parts per million by weight of sulfur compounds and less than or equal to 0.5 parts per million by weight of nitrogen compounds based on the total weight of the desulfurized naphtha feed.

A twelfth aspect of the present disclosure may include any one of the first through the eleventh aspects, where a supplemental FCC feed is combined with the cyclization effluent in the FCC unit.

A thirteenth aspect of the present disclosure may include the twelfth aspect, where the supplemental FCC feed comprises vacuum gas oil, demetallized oil, atmospheric residue, or combinations of these.

A fourteenth aspect of the present disclosure may include any one of the first through the thirteenth aspects, where the naphtha feed comprises $C_5$ to $C_{12}$ hydrocarbons.

A fifteenth aspect of the present disclosure may include any one of the first through the fourteenth aspects, where the naphtha feed comprises a boiling point ranging from 9 degrees Celsius to 220 degrees Celsius.

A sixteenth aspect of the present disclosure may include any one of the first through the fifteenth aspects, where the light naphtha fraction comprises $C_5$ to $C_6$ hydrocarbons.

A seventeenth aspect of the present disclosure may include any one of the first through the sixteenth aspects, where the light naphtha fraction comprises constituents of the naphtha feed having boiling point temperatures less than or equal to 70 degrees Celsius.

An eighteenth aspect of the present disclosure may include any one of the first through the seventeenth aspects, where the heavy naphtha fraction comprises constituents of the naphtha feed having boiling point temperatures greater than 70 degrees Celsius.

A nineteenth aspect of the present disclosure may include any one of the first through the eighteenth aspects, where the heavy naphtha fraction comprises $C_7$ to $C_{12}$ hydrocarbons.

A twentieth aspect of the present disclosure may include any one of the first through the nineteenth aspects, where contacting the light naphtha fraction with hydrogen in the presence of at least one cyclization catalyst causes at least a portion of paraffin compounds in the light naphtha fraction to undergo a cyclization reaction to produce naphthenes.

A twenty-first aspect of the present disclosure may include any one of the first through the twentieth aspects, where the cyclization catalyst comprises a FAU-framework zeolite, a MFI-framework zeolite, a BEA-framework zeolite, a MOR-framework zeolite, a MFI-framework zeolite, or a MWW-framework zeolite.

A twenty-second aspect of the present disclosure may include the twenty-first aspect, where the cyclization catalyst comprises from 0.01 weight percent to 40 weight percent iron, cobalt, nickel, rhodium, palladium, silver, iridium, platinum, gold, molybdenum, tungsten, or combinations thereof. In embodiments, the cyclization catalyst may comprise from 0.01 weight percent to 40 weight percent platinum.

A twenty-third aspect of the present disclosure may include any one of the first through twenty-second aspects, where the cracking catalyst does not comprise an active phase metal.

A twenty-fourth aspect of the present disclosure may include any one of the first through the twenty-third aspects, where the cyclization catalyst comprises a framework-substitute ultra-stable Y-type zeolite comprising one or more transition metals substituted into the framework of an ultra-stable Y-type zeolite.

A twenty-fifth aspect of the present disclosure may include the twenty-fourth aspect, where the framework-substituted USY zeolite comprises a crystal lattice constant from 2.430 nanometers to 2.450 nanometers and a specific surface area from 600 square meters per gram to 900 square meters per gram.

A twenty-sixth aspect of the present disclosure may include the twenty-fourth aspect, where the one or more metals comprises hafnium, zirconium, titanium, or combinations of these.

A twenty-seventh aspect of the present disclosure may include either the twenty-fourth aspect or the twenty-fifth aspect, where the cyclization catalyst comprises from 1 weight percent to 80 weight percent framework-substituted ultra-stable Y-type zeolite based on the total weight of the cyclization catalyst and platinum as an active phase metal supported on the framework-substituted ultra-stable Y-type zeolite.

A twenty-eighth aspect of the present disclosure may include any one of the first through the twenty-seventh aspects, where the light naphtha fraction is contacted with hydrogen in the presence of the cyclization catalyst at a molar ratio of hydrogen to light naphtha fraction of from 1 to 10.

A twenty-ninth aspect of the present disclosure may include any one of the first through the twenty-eighth aspects, where the light naphtha fraction is contacted with hydrogen in the presence of the cyclization catalyst at a liquid hourly space velocity ranging from 1 $h^{-1}$ to 10 $h^{-1}$.

A thirtieth aspect of the present disclosure may include any one of the first through the twenty-ninth aspects, where the light naphtha fraction is contacted with hydrogen in the presence of the cyclization catalyst at a pressure of from 10 bar to 40 bar.

A thirty-first aspect of the present disclosure may include any one of the first through the thirtieth aspects, where the light naphtha fraction is contacted with hydrogen in the presence of the cyclization catalyst at a temperature of from 350 degrees Celsius to 550 degrees Celsius.

A thirty-second aspect of the present disclosure may include a process for upgrading a naphtha feed, the process comprising: separating the naphtha feed into at least a light naphtha fraction and a heavy naphtha fraction; contacting the light naphtha fraction with hydrogen in the presence of at least one cyclization catalyst to produce a cyclization effluent comprising a greater concentration of naphthenes compared to the light naphtha fraction; and contacting the cyclization effluent with at least one cracking catalyst under conditions sufficient to crack at least a portion of the cyclization effluent to produce a fluid catalytic cracking effluent comprising light olefins, gasoline blending components, or both.

A thirty-third aspect of the present disclosure may include the thirty-second aspect, further comprising reforming the heavy naphtha fraction to produce a naphtha reformate.

A thirty-fourth aspect of the present disclosure may include the thirty-third aspect, further comprising combining a portion of the fluid catalytic cracking effluent and the naphtha reformate to produce gasoline.

A thirty-fifth aspect of the present disclosure may include the thirty-fourth aspect, where the gasoline comprises an octane number greater than 100.

A thirty-sixth aspect of the present disclosure may include the thirty-third aspect, further comprising treating a portion of the fluid catalytic cracking effluent and the naphtha reformate to produce benzene, toluene, xylene, or combinations of these.

A thirty-seventh aspect of the present disclosure may include the thirty-sixth aspect, where the portion of the fluid catalytic cracking effluent comprises gasoline blending components.

A thirty-eighth aspect of the present disclosure may include any one of the thirty-second through the thirty-seventh aspects, where the supplemental FCC feed comprises vacuum gas oil, demetallized oil, atmospheric residue, or combinations of these.

A thirty-ninth aspect of the present disclosure may include the thirty-eighth aspect, where the supplemental FCC feed comprises vacuum gas oil, demetallized oil, atmospheric residue, or combinations of these.

A fortieth aspect of the present disclosure may include the thirty-ninth aspect, comprising combining the supplemental FCC feed with the cyclization effluent.

A forty-first aspect of the present disclosure may include any one of the thirty-second through fortieth aspects, further comprising contacting the naphtha feed with hydrogen in the presence of a desulfurization catalyst prior to separating the naphtha feed into the light naphtha fraction and the heavy naphtha fraction, where the contacting causes at least a portion of sulfur components to be removed from the naphtha feed to produce a desulfurized naphtha feed.

A forty-second aspect of the present disclosure may include the forty-first aspect, where the desulfurized naphtha feed comprises less than 0.5 parts per million by weight of sulfur components.

A forty-third aspect of the present disclosure may include a system for upgrading a naphtha feed, the system comprising: a naphtha separation unit operable to separate a naphtha feed into at least a light naphtha fraction and a heavy naphtha fraction; a cyclization unit disposed downstream of the naphtha separation unit and operable to contact the light naphtha fraction with hydrogen in the presence of at least one cyclization catalyst to produce a cyclization effluent; and a fluid catalytic cracking unit disposed downstream of the cyclization unit and operable to crack the cyclization effluent to produce a fluid catalytic cracking effluent.

A forty-fourth aspect of the present disclosure may include the forty-third aspect, further comprising a naphtha reforming unit disposed downstream of the naphtha separation unit, the naphtha reforming unit operable to reform at least a portion of the heavy naphtha fraction to produce a naphtha reformate.

A forty-fifth aspect of the present disclosure may include either the forty-third or the forty-fourth aspect, further comprising a desulfurization unit disposed upstream of the naphtha separation unit operable to contact the naphtha feed at least one desulfurization catalyst to produce a desulfurized naphtha feed.

A forty-sixth aspect of the present disclosure may include any one of the forty-third through the forty-fourth aspects, where the cyclization unit is in direct fluid communication with the naphtha separation unit.

A forty-seventh aspect of the present disclosure may include any one of the forty-third through the forty-sixth aspects, where the fluid catalytic cracking unit is in direct fluid communication with the cyclization unit.

A forty-eighth aspect of the present disclosure may include the forty-seventh aspect, where the cyclization unit is in direct fluid communication with the naphtha separation unit and the cyclization unit.

A forty-ninth aspect of the present disclosure may include any one of the forty-fourth through forty-eighth aspects, further comprising an aromatic recovery complex disposed downstream of the fluid catalytic cracking unit and the naphtha reforming unit and operable to separate at least a portion of the fluid catalytic cracking effluent, at least a portion of the naphtha reformate, or both into benzene, toluene, xylene, or combinations of these.

It is noted that one or more of the following claims utilize the term "where" as a transitional phrase. For the purposes of defining the present technology, it is noted that this term is introduced in the claims as an open-ended transitional phrase that is used to introduce a recitation of a series of characteristics of the structure and should be interpreted in like manner as the more commonly used open-ended preamble term "comprising."

It should be understood that any two quantitative values assigned to a property may constitute a range of that property, and all combinations of ranges formed from all stated quantitative values of a given property are contemplated in this disclosure.

Having described the subject matter of the present disclosure in detail and by reference to specific embodiments, it is noted that the various details described in this disclosure should not be taken to imply that these details relate to elements that are essential components of the various embodiments described in this disclosure, even in cases where a particular element is illustrated in each of the drawings that accompany the present description. Rather, the claims appended hereto should be taken as the sole representation of the breadth of the present disclosure and the corresponding scope of the various embodiments described in this disclosure. Further, it will be apparent that modifications and variations are possible without departing from the scope of the appended claims.

What is claimed is:

1. A process for separating and upgrading a naphtha feed, the process comprising:

passing the naphtha feed to a naphtha separation unit that separates the naphtha feed into at least a light naphtha fraction and a heavy naphtha fraction;

passing the light naphtha fraction to a cyclization unit that contacts the light naphtha fraction with hydrogen in the presence of at least one cyclization catalyst to produce a cyclization effluent comprising a greater concentration of naphthenes compared to the light naphtha fraction, wherein the at least one cyclization catalyst comprises ultra-stable Y-type (USY) zeolite and platinum as an active phase metal supported on the USY zeolite, the cyclization catalyst comprises from 60 weight percent to 80 weight percent USY zeolite based on the total weight of the cyclization catalyst, and the cyclization unit operates at a temperature of 475° C., a hydrogen partial pressure of 0.3 MPa (3 bar), and a molar ratio of hydrogen to light naphtha fraction of 3; and passing the cyclization effluent to a fluid catalytic cracking unit that contacts the cyclization effluent with at least one cracking catalyst at a temperature of from 650° C. to 700° C., a pressure of from 0.1 1VIPa to 1 1VIPa, and a weight ratio of the cracking catalyst to the cyclization effluent feed of from 1:2 to 1:30, where the contact of the cyclization effluent with the at least one cracking catalyst cracks at least a portion of the cyclization effluent to produce a fluid catalytic cracking effluent comprising light olefins, gasoline blending components, or both;

passing the heavy naphtha fraction to a naphtha reforming unit that contacts the heavy naphtha fraction with at least one reforming catalyst to undergo one or more reactions under conditions sufficient to produce a reformate effluent, wherein the at least one reforming catalyst consists of:

a precious metal selected from the group consisting of platinum, palladium, and combinations thereof; and a catalyst support selected from the group consisting of alumina, silica, titania, and combinations thereof.

2. The process of claim 1, further comprising passing a portion of the fluid catalytic cracking effluent, at least a portion of the naphtha reformate, or both to a gasoline pool.

3. The process of claim 1, further comprising passing a portion of the fluid catalytic cracking effluent, at least a portion of the naphtha reformate, or both to an aromatic recovery complex to produce benzene, toluene, xylene, or combinations of these.

4. The process of claim 1, further comprising passing a supplemental FCC feed to the fluid catalytic cracking unit and contacting the supplemental FCC feed and the cyclization effluent with the at least one cracking catalyst to produce the fluid catalytic cracking effluent, where the supplemental FCC feed comprises vacuum gas oil, demetalli7ed oil, atmospheric residue, or combinations of these.

5. The process of claim 1, further comprising contacting the naphtha feed with hydrogen in the presence of a desulfurization catalyst in a desulfurization unit prior to separating the naphtha feed into the light naphtha fraction and the heavy naphtha fraction, where the contacting causes at least a portion of sulfur components to be removed from the naphtha feed to produce a desulfurized naphtha feed.

6. The process of claim 5, where the desulfurized naphtha feed comprises less than or equal to 0.5 parts per million by weight of sulfur compounds and less than or equal to 0.5 parts per million by of weight nitrogen compounds based on the total weight of the desulfurized naphtha feed.

7. The process of claim 1, where the light naphtha fraction comprises constituents of the naphtha feed having boiling point temperatures less than or equal to 70 degrees Celsius.

8. The process of claim 1, where the heavy naphtha fraction comprises constituents of the naphtha feed having boiling point temperatures greater than 70 degrees Celsius.

9. The process of claim 1, where contacting the light naphtha fraction with hydrogen in the presence of at least one cyclization catalyst causes at least a portion of paraffin compounds in the light naphtha fraction to undergo a cyclization reaction to produce naphthenes.

10. The process of claim 1, where the cyclization catalyst comprises from 0.01 weight percent to 40 weight percent platinum.

11. The process of claim 1, where the light naphtha fraction is contacted with hydrogen in the presence of the cyclization catalyst at a liquid hourly space velocity ranging from 1 $h^{-1}$ to 10 $h^{-1}$.

12. The process of claim 1, further comprising:

contacting the naphtha feed with hydrogen in the presence of a desulfurization catalyst, where the contacting causes at least a portion of sulfur components to be removed from the naphtha feed to produce a desulfurized naphtha feed, wherein the desulfurization catalyst comprises nickel, molybdenum, cobalt, or combinations of these and wherein the desulfurization catalyst further comprises a dopant comprising silicon.

13. The process of claim 1, wherein the cyclization effluent comprises greater than 26 wt. % naphthenes based on the total weight of the cyclization effluent.

14. The process of claim 1, wherein the naphtha feed comprises $C_5$-$C_6$ drocarbons and the light naphtha fraction comprises at least 80% by weight of the $C_5$-$C_6$ drocarbons of the naphtha feed.

15. The process of claim 1, wherein the naphtha feed comprises $C_{7+}$hydrocarbons and the heavy naphtha fraction comprises at least 80% by weight of the $C_{7+}$hydrocarbons of the naphtha feed.

16. The process of claim 1, the process further comprising:

separating the reformate effluent into at least a naphtha reformate effluent and a hydrogen effluent;

passing at least a portion of the naphtha reformate effluent and at least a portion of the fluid catalytic cracking effluent to an aromatic recovery complex; and recovering a product comprising one or more of benzene, toluene, xylene, or combinations of thereof from the at least a portion of the naphtha reformate effluent and the at least a portion of the fluid catalytic cracking effluent in the aromatic recovery complex.

17. The process of claim 16, the process further comprising:

passing the fluid catalytic cracking effluent to a fluid catalytic cracking separation unit;

separating the fluid catalytic cracking effluent into at least a light gas fraction, a light naphtha recycle fraction, an aromatic containing effluent, and a light olefin fraction, or combinations of these in the fluid catalytic cracking separation unit; and passing the light naphtha recycle fraction to the fluid catalytic cracking unit.

18. The process of claim 17, the process further comprising:

combining the light naphtha recycle fraction with the cyclization effluent upstream of the fluid catalytic cracking unit; and passing the light naphtha and cyclization effluent to the fluid catalytic cracking unit.

* * * * *